United States Patent [19]

Love, III

[11] Patent Number: 4,729,310

[45] Date of Patent: Mar. 8, 1988

[54] PRINTING METHOD

[75] Inventor: Franklin S. Love, III, Spartanburg, S.C.

[73] Assignee: Milliken Research Corporation, Spartanburg, S.C.

[21] Appl. No.: 406,700

[22] Filed: Aug. 9, 1982

[51] Int. Cl.[4] ..... B41F 9/00

[52] U.S. Cl. ..... 101/157; 101/170; 101/466; 346/163; 346/21

[58] Field of Search ..... 101/DIG. 2, 459, 466, 101/467, 170, 463.1, 451, 450.1, 465; 340/135, 21, 163

[56] References Cited

U.S. PATENT DOCUMENTS

| | | | |
|---|---|---|---|
| 607,915 | 7/1898 | Cornwall | 101/170 |
| 865,719 | 9/1907 | Murray | 101/459 |
| 1,740,423 | 12/1929 | Kohn | 101/466 |
| 1,777,947 | 10/1930 | Valtat | 346/21 |
| 2,016,517 | 10/1935 | Rowell | 101/466 |
| 2,129,071 | 9/1938 | Rowell | 101/466 |
| 2,200,363 | 5/1940 | Kreis | 101/466 |
| 2,340,562 | 2/1944 | Rey | 346/21 |
| 2,713,822 | 7/1955 | Newman | 101/460 |
| 3,060,848 | 10/1962 | Beutner | 101/466 |
| 3,113,512 | 12/1963 | Newman | 101/DIG. 2 |
| 3,220,345 | 11/1965 | Kline | 346/135 |
| 3,278,958 | 10/1966 | Regan | 101/467 |
| 3,285,742 | 11/1966 | Wagner | 101/467 |
| 3,648,603 | 3/1972 | Kaminstein | 101/450.1 |
| 3,650,743 | 3/1972 | Hallman | 101/467 |
| 3,999,481 | 12/1976 | Sankus | 101/451 |
| 4,097,637 | 6/1978 | Loria | 346/163 |
| 4,292,397 | 9/1981 | Takeuchi | 101/466 |
| 4,405,709 | 9/1983 | Katano | 101/463.1 |

FOREIGN PATENT DOCUMENTS

| | | | |
|---|---|---|---|
| 203907 | 8/1955 | Australia | 101/465 |
| 2550774 | 5/1976 | Fed. Rep. of Germany | 101/170 |
| 2752500 | 2/1979 | Fed. Rep. of Germany | 101/170 |
| 138702 | 10/1979 | Japan | 101/465 |
| 62157 | 5/1981 | Japan | 101/450.1 |
| 486995 | 4/1970 | Switzerland | 101/170 |
| 498728 | 12/1970 | Switzerland | 101/170 |
| 225015 | 11/1924 | United Kingdom | 101/170 |
| 1309311 | 3/1973 | United Kingdom | 101/465 |

*Primary Examiner*—Clyde I. Coughenour
*Attorney, Agent, or Firm*—George M. Fisher; H. William Petry

[57] ABSTRACT

A printing system incorporating a re-usable ink image transfer surface. A material which forms a thin hydrophobic layer is arranged by various techniques over a substantially hydrophilic transfer surface in a configuration which defines the desired latent image in terms of exposed, contiguous hydrophilic and hydrophobic areas. In some cases, a hydrophilic layer may be in direct contact with the hydrophobic layer. Depending upon the configuration of the layers, either an aqueous or oleo ink may be used to develop and print an image. If desired, the layer configuration may be replaced by a different configuration without substantial interruption to the printing process. No photo-induced chemical reaction or latent image developing steps are required at any time. The ink image transfer surface may be a planographic gravure cylinder or a gravure roll.

16 Claims, 11 Drawing Figures

PRINTING METHOD

BACKGROUND OF THE INVENTION

This invention relates to printing systems using a printing element on which the image is defined in terms of contiguous hydrophilic and relatively hydrophobic regions, and which is capable of serving as a printing plate or other analogous source of a transferrable ink image. More specifically, this invention relates to a novel printing system comprising a non-photosensitive, reusable printing surface suitable for use in a lithographic-type or other printing system, on which an ink image may be formed, refreshed, or completely reconfigured electronically, without a separate development or plate making step, without removal of the printing element, and without substantial interruption of the printing process.

In modern printing systems using printing plates such as letter-press and intaglio or gravure systems, the image portions of the printing plate are defined in terms of raised or recessed areas of the plate surface which are made to carry ink. In planographic systems such as lithography, however, the image portions of the printing plate, i.e. those portions of the printing plate surface intended to carry ink, are formed at substantially the same surface level as the rest of the plate. Rather than depend upon the relative elevation of portions of the plate surface to define the ink-bearing image, planographic systems depend upon certain areas of the plate having a greater relative affinity for water than is shown by the remaining areas of the plate.

In a typical lithographic printing system, the relative immiscibility of grease and water is used to define and maintain the image and non-image areas of the printing plate. In standard lithographic printing systems where greasy-type or oleo inks are used, the lithographic plate is made oleophilic (grease-loving) and hydrophobic (water-hating) in image areas (i.e., those areas which will receive and transfer ink to the paper sheet or other material to be printed), and hydrophilic (water-loving) in the non-image areas. These latter areas, which are in image-complementary configuration, are sometimes referred to as "lithographically blank" areas, because they normally carry or transfer no ink. So long as sufficient water is present in these lithographically blank areas, no oleo-type ink will adhere to the plate in these non-image areas. By this arrangement, these hydrophilic, image-complementary areas of the plate will retain preferentially an aqueous fountain or dampening fluid applied to the plate to the exclusion of the remaining portions of the plate, and will thereby allow the greasy ink applied thereafter to adhere only to the oleophilic areas of the plate intended to carry the ink image.

Various techniques have been developed for establishing the hydrophilic and hydrophobic aras of the printing plate. The most popular method of establishing such image-defining areas is with the aid of light sensitive materials which tend to undergo chemical reactions when exposed to actinic light. In a typical process, when using negative-imaged films, the so-called "negative" plate is covered with a layer of a light sensitive diazo or photopolymeric formulation. Strong light energy passing through the negative film and striking the plate causes the diazo or photopolymeric formulation in the exposed or imaged areas of the plate to undergo a chemical change, e.g., to polymerize, forming thereby a hardened, hydrophobic, ink receptive area. The non-polymerized formulation in the unexposed or image-complementary areas of the plate is removed by washing the plate surface with a solution in which only the unexposed, non-polymerized formulation is readily soluble. These unexposed, washed areas are then treated with gum, i.e., a gum formulation containing gum arabic, carboxymethyl cellulose gum, or the like. Often, the non-polymerized formulation is washed away and the gum added in a single step. If a long wearing plate is desired, a thin film of a gum-containing material may be rubbed onto or otherwise applied to the plate and the plate surface washed with water, thereby causing a water insoluble layer of gum to be adsorbed onto the unexposed or image-complementary areas of the plate surface, and forming a highly hydrophilic surface which will wet readily with water, and will thereafter reject ink.

If a positive rather than a negative type film is used, the so-called "positive" plate is first sensitized with a light sensitive coating which degrades when exposed to actinic light. Exposure of the plate, via the positive film, then results in degradation of the coating in what will be the image-complementary (i.e., non-ink-carrying) portions of the image. The coated plate is chemically washed to remove the degraded areas of the coating. The plate is then baked to harden the coating in the image (i.e., ink-carrying) areas, and coated with a gum-containing material such as gum arabic or the like, as is done with the "negative" plate discussed above.

Systems using light sensitive materials customarily require the preparation of a photographically-generated film negative or positive transparency, as well as the careful projection of the image carried by the transparency onto the light sensitive surface of the plate. In certain systems, e.g., in so-called photo-direct systems, a plate may be exposed directly by the original copy without the need for an intermediate film transparency. In either case, however, it is usually necessary that the resulting plate be developed and rinsed and a finishing solution usually must be applied.

Electrostatic systems for generating a lithographic plate may be based on use of either a hydrophilic or a hydrophobic toner material. If, for example, a hydrophobic toner material is used, a plate surface comprising a photoconductive material which is hydrophilic is given a uniform electrical charge prior to being exposed to light striking the plate in image-complementary configuration. The light causes neutralization of the electrical charge in the illuminated areas of the plate. To develop the plate, a toner carrying a charge opposite to that of the remaining charged areas of the plate is then applied and made to stick to the plate surface. After fusing, the toned areas become hydrophobic, while the untoned areas remain hydrophilic. Use of a hydrophilic toner material employs analogous process steps with an initially hydrophobic plate surface.

The lithographic-type plates produced by the various techniques discussed above, as used in printing presses and processes of conventional design, generally exhibit substantial deficiencies which are well known and commonly encountered in the printing industry. Representative of these deficiencies are the following:

(1) inability to generate a high quality lithographic-type printing plate without film preparation steps or without elaborate plate exposure and development procedures;

(2) inability to reconfigure completely the image being printed by the plate without substantial interruption of the printing process or substitution of a second plate carrying the desired reconfigured image;

(3) inability to refresh or renew the oleophilic and hydrophilic areas of the image carried by the printing plate without substantial interruption of the printing process;

(4) inability to correct minor deficiencies in the image being printed by the plate—for example, those deficiencies caused by incomplete or unintended removal of material from the plate surface, or by foreign matter residing on the plate surface—without substantial interruption of the printing process;

(5) inability to correct substantial registration errors in the plate without re-plating;

(6) inability to print a continuously repeating pattern on a web substrate using a rotary-type press without a gap or seam between plate image pattern repeats and without the use of additional plates or ink heads;

(7) inability to print a pattern wherein the repeat length is greater than, or wherein the repeat length will not integrally divide into, the plate length or circumference of the plate roll;

(8) inability to eliminate roll shock, i.e., the mechanical interaction between the respective gaps of the plate and blanket rolls in rotary offset printing methods, which limits press speeds;

(9) inability to proof conveniently a freshly generated plate under true production conditions, using production inks, papers, etc.;

(10) inability to store the equivalent of a large library of printing plates for short or periodic printing runs without substantial maintenance and inventory costs;

(11) inability to generate a lithographic-type printing plate, which requires no separate developing process, or print imagery using a lithographic-type printing process, directly from a source of electronically-generated images such as a digital computer.

Attempts to overcome these and other deficiencies of existing systems generally have met with only limited success. Disclosed herein is a printing system employing a reusable printing plate which overcomes all of the above-listed deficiencies, as well as others associated with almost all photolithographic techniques, such as halation (i.e., imperfect light exposure caused by the reflective nature of the printing plate supporting base).

A substantially planographic plate suitable for service in a lithographic-type printing system is described herein which is comprised of an intrinsically hydrophilic plate material which supports a thin hydrophobic layer thereon. Also described herein is a method for generating, imaging, and using such a plate to print electronically generated images in various printing processes. According to the teachings herein, a method for generating a plate for use in a lithographic-type printing system comprises coating uniformly an intrinsically hydrophilic support surface with a thin hydrophobic layer of a suitable material, then selectively removing the material in a pre-determined configuration by means of an electronically addressable imaging system utilizing an electric spark discharge, a beam of electromagnetic energy (e.g., a laser beam), a beam of ionized particles, or other means. Alternatively, the hydrophilic plate surface may be first coated with a thin layer of a hydrophilic protective material, for example, a gum-containing material, prior to the application and selective removal of the material forming the hydrophobic layer. As additionally taught herein, suitable material for forming a hydrophobic layer may be directly, selectively applied to the plate in the desired configuration. Whether selectively removed or selectively applied, the hydrophobic layer material may be said to be arranged over the plate surface in a desired image-related configuration. These as well as other developments, all of which involve a reusable, easily re-imageable ink image generation surface useful in various printing processes, are described herein. As used herein, ink image generation surface is intended to mean the surface on which the ink image corresponding to the desired printed image is initially formed. This surface generally will be the surface on which a pre-ink latent image, i.e., an image defined in terms of adjacent hydrophilic and hydrophobic areas, is also initially formed. The term "imaging" is intended to mean the generation of this latent image, prior to the application of ink.

Described herein is a surface suitable for use, for example, as a planographic printing plate in either rotary or non-rotary printing systems wherein an electronically embodied image may be impressed directly onto the plate, without requiring the use of photosensitive materials or coatings, or without elaborate developing steps. In addition, the disclosed surface is re-usable, in the sense that a lithographic plate, for example, when imaged and used for printing in accordance with the teachings of this invention, may be re-imaged with the same or with a totally different image without the need for replacing the plate. In fact, an image having a length greater than (or not an integral divisor of) the circumference of the plate roll, where such roll is used, may be printed by changing the image associated with one portion of the plate roll while another portion of the roll is transferring an ink image to an offset roll or directly to a substrate.

Throughout this discussion, the terms "printing plate" or "plate" shall be used to describe a substantially flat, planographic surface capable of recording an image defined in terms of hydrophobic and relatively hydrophilic areas; such a surface may be the ink transfer surface associated with either a planar or curved lithographic printing plate, and may even be, for example, the print roll surface itself and not a separate, detachable entity usually associated with the term "plate." The printing plate may take the form of a planar surface, a cylinder, an endless belt, or other form. It is foreseen that the printing element as described herein may also comprise the printed product, e.g., the plate need not serve as an ink transfer surface, but as the printed substrate itself. In addition, other, non-planographic surfaces may be employed as well.

A method and apparatus is herein disclosed which can completely eliminate the costs associated with generating a plate using conventional photolithographic techniques, as well as the costs involved in maintaining a conventional plate library for short-run or periodic printing jobs. The necessity of replacing a plate when a sharpened, or slightly modified, or totally reconfigured image is desired is completely eliminated. The costs and limitations associated with having gaps in the plate used in rotary-type presses which cause a printing gap or seam in matter printed on long webs, as well as the mechanical shock associated with such plate gaps and the speed limitations such plate gaps impose, can be completely eliminated by imaging the roll surface as herein described, rather than imaging a separately attached printing plate of conventional design. Additionally, a series of pre-production run proofs may be generated inexpensively, and with the advantage that the proofs may be printed on the same machine, using the same plate, paper, inks, and many of the same press adjustments as the final production run, thereby eliminating any doubt whatsoever as to the appearance of the final printed image. Whatever adjustments are necessary to develop a satisfactory proof, regardless of their magnitude, can be made to the plate without removing the plate from the press, or having to make ready and install an entirely new plate.

The teachings herein may be used in a wide variety of printing applications, particularly where, for example, minimal costs for plate preparation, set up, storage, or inventory are desired, or where no gap or seam between plate images on a continuous printed substrate is desired. Because of the lack of any plate gap or seam, and any corresponding mechanical shock originating therefrom, the teachings herein are also particularly suited to applications wherein high speed printing (e.g., high speed rotogravure speeds) is desired.

Other features and advantages will become apparent from the following detailed description in which reference is made to the Figures summarized below.

DESCRIPTION OF PREFERRED EMBODIMENTS

Figure 1:
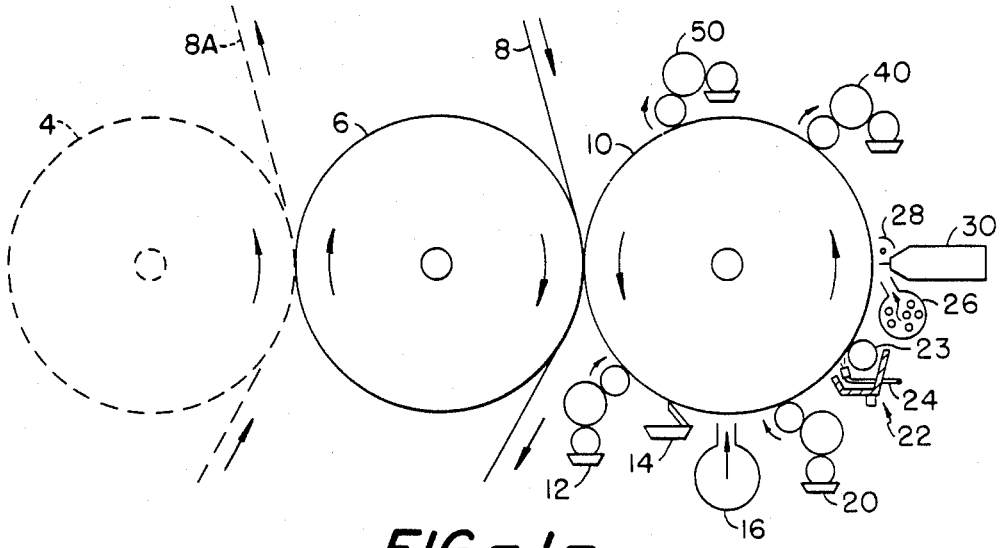
FIG. 1 schematically depicts a rotary printing system using printing plate described herein is being continuously erased and re-imaged by means of an electric spark discharge means while the plate is transferring a portion of the image onto a web substrate.

In the apparatus and process depicted in FIG. 1, a plate roll or cylinder 10 is continuously re-imaged with the same or a different image or pattern at the same time a substrate 8 is being printed. As suggested above, the plate may take a form other than a roll or cylinder. For example, the apparatus of FIG. 1 could be modified to accommodate an endless belt having a suitable hydrophilic surface, rather than the roll shown.

The process depicted in FIG. 1, which may be a lithographic process in which an oleo ink is employed, will be explained beginning with cleaning roll stack 12. Stack 12 applies a conventional cleaning solvent to the surface of roll 10 which, in conjunction with soft doctor blade 14 and solvent drying jets 16, removes all traces of ink, fountain solution, solvent, and foreign matter, without marring the roll surface. If removal of any previously applied hydrophobic layer material is necessary, it may be removed with heat, solvents, or, perhaps most simply, by activating the imaging means to produce a totally "blank" or hydrophilic plate, as will be discussed later. Similar procedures may be employed if removal of gum is desired, as will be discussed later.

The roll surface of plate roll 10 is comprised of a material which is intrinsically substantially hydrophilic—a material having a surface which, when clean, i.e., free of significant contamination, is substantially hydrophilic. Any suitable intrinsically substantially hydrophilic material may be used in the present invention. Typical suitable hydrophilic materials include, but are not necessarily limited to, metals such as nickel, copper, tin, aluminum, stainless steel, zinc, brass, phosphor bronze, titanium, zirconium, palladium, niobium, platinum, lead, molybdenum, tantalum, tungsten, iron, and gold, as well as non-metallic materials such as an aluminum oxide/titanium dioxide composite (60% $Al_2O_3$, 40% $TiO_2$), and mixtures thereof. While any suitable intrinsically hydrophilic material may be used with this invention, stainless steel and aluminum are particularly suitable for many applications. If, under some circumstances, the roll material chosen tends to form a relatively hydrophobic coating (e.g., a coating of airborne contaminants, etc.) upon exposure to the atmosphere, it may be desirable to coat the roll surface with a layer of a suitable protective material, for example, a gum formulation containing gum arabic, carboxymethyl cellulose gum, or the like, which formulation will herein be referred to simply as "gum." Such coating is also recommended if maximum longevity of the image on the roll is desired. If done immediately following the imaging process, the gum is attracted to the exposed hydrophilic areas and tends to form a protective coating over these hydrophilic areas which is itself hydrophilic, thus protecting and preserving the image and extending plate wear. Alternatively, such coating may be applied prior to the application of the hydrophobic layer material, as will be discussed hereinbelow.

Applicator 20 applies a thin layer of a suitable hydrophobic layer material through the action of a roll stack 20 which extends across the width of roll 10. The action of doctoring means 22, here depicted as a roll 23 preceded by a water jet wash sytem 24, removes excess material, and assures a thin, relatively uniform and continuous hydrophobic layer of material on the surface of roll 10. Any suitable thickness of hydrophobic layer material and means or method of application may be used. In many applications, however, a layer thickness which approaches monomolecular dimensions has been found to be quite satisfactory and is preferred from the standpoint of uniformity of application and ease of cleaning when using many of the hydrophobic layer materials suggested and discussed hereinbelow. Any method or means for applying suitable quantities of the hydrophobic layer material which results in relatively uniform and complete coverage of the roll surface, and which does not contaminate the roll surface, may be used. For example, an atomizer may be employed. A preferred applicator, however, is a roll train fed from a trough of the hydrophobic layer material, immediately followed by a water flush and contact with a doctoring roll or blade, substantially as depicted in FIGS. 1–4. It is generally advantageous to use application techniques which result in the application of a layer which is self-limiting in thickness, preferably approximately monomolecular in thickness.

While any suitable material may be used to form the hydrophobic layer of the plate, the material chosen preferably should meet several requirements in order to achieve the highest quality in the resulting printed image. It preferably should be a material which, when applied to the roll or plate in a thin layer, effectively renders the roll or plate substantially uniformly hydrophobic and oleophilic, by providing a hydrophobic and oleophilic layer thereon, which exhibits a relatively large wetting angle with respect to the desired aqueous developer material used, an affinity for the type of printing ink to be used, and which is relatively durable. Equally important, it preferably should be a material which has an affinity for the roll surface and which can be applied in a thin, smooth layer over the roll surface, as well as over small quantities of any contaminants or residual material which may be found thereon, without significant discontinuities or open areas, thereby forming a layer which is substantially uniformly hydrophobic. Materials which can be applied in a relatively uniform, homogeneous layer have been found to be effective in providing a substantially uniformly hydrophobic layer. It has been found that a layer of hydrophobic layer material having a thickness which approaches or approximates monomolecular dimensions and which appears to be adsorbed onto the surface of the roll is quite effective, and is generally preferred; for this reason, materials which readily yield such layers, for example, as the result of self-limiting application techniques, are generally preferred. The descriptions which follow will speak in terms of an adsorbed layer of material. It should be understood that, while it is believed adsorbed, monomolecular layers are achieved, somewhat thicker layers may actually be resulting from the techniques described herein. Under certain conditions, substantially thicker layers may be preferred (see, e.g., tetracosane, Table I, and discussion hereinbelow). A thin layer, however, is generally easier to remove than a thicker layer, usually results in fewer problems with generation of possibly undesirable vapors, etc., and is therefore generally preferred over a thickness layer of the same material. For maximum versatility, the material may be one which does not leave a residue upon heating to temperatures of about 345° C. or above. It is thought that meeting this test assures that the roll or plate coated with the material may be erased and re-imaged a large number of times without experiencing problems with residue buildup. If generation of a longer lasting image on the roll is desired, e.g., if no periodic re-imaging is to be provided, it is desirable that the material chosen be relatively unaffected by exposure to the fountain solution or ink, to the atmosphere over the time period during which the plate is to be used, or to whatever gum-containing formulation is used. It is also recommended that the material chosen be one which, after being applied to the roll, does not readily migrate, i.e., does not transfer itself either onto surfaces contacting the plate or roll surface, or into hydrophilic areas on the plate or roll surface. Unlike systems of the prior art, there is no requirement that the material be photosensitive or photo-chemically reactive, or that the material be comprised of a polymer, an oligomer, or a material which is subject to polymerization, oligomerization, or cross-linking. Suitable polymer or oligomer-containing or cross-linkable materials, may be employed if desired, however (see, e.g., polyvinyl butyral, Table I). There is also no requirement that the material be readily dissolvable in a wash or developing solution.

A variety of materials have been found to meet these requirements. Table I lists typical examples of these materials, along with the particular solvents used in the application of these materials to the noted metal shim stock, and the contact angles observed in laboratory contact angle tests, as measured manually with an optical comparator. The measured contact angle, which corresponds to the wetting angle as defined by the Young equation, is an inverse measurement of the spreadability or wettability of a liquid—in this case, distilled water—on a solid surface—in this case, the plate surface carrying a thin layer of the material being tested. The lower the observed contact or wetting angle, the more wettable the surface is by the distilled water and, presumably, the less suitable the material comprising the layer may be as a hydrophobic layer material for use with an aqueous fountain solution in a lithographic-type printing process. The solvent temperatures were approximately 22° C. unless otherwise specified. The contact angles were observed on a section Type 304 stainless steel shim stock which was pretreated by placement in a muffle furnace at approximately 345° C. for one minute. Except where noted below, the shim was dipped quickly in the solvent containing the recited concentration of material, removed, quickly and thoroughly rinsed with distilled water, and the contact angle measured. Several trials for each material were performed. Angles marked with an asterisk indicate that lower contact angles were obtained on some trials with these particular materials; it is thought these materials may be somewhat sensitive to the uniformity of the application process.

TABLE I

| MATERIAL | SOLUTION DATA | CONTACT ANGLE |
|---|---|---|
| CARBOXYLIC ACIDS | | |
| Tetradecanoic Acid | 0.1%(wt.) in 50/50(vol.) 2-Propanol/Dist. Water | 125° |
| Hexadecanoic Acid | 0.1%(wt.) in 50/50(vol.) 2-Propanol/Dist. Water | 126° |
| Octadecanoic Acid | 0.1%(wt.) in 50/50(vol.) | 130° |

TABLE I-continued

| MATERIAL | SOLUTION DATA | CONTACT ANGLE |
|---|---|---|
| | 2-Propanol/Dist. Water | |
| Oleic Acid | 0.1%(wt.) in 50/50(vol.) 2-Propanol/Dist. Water | 98° |
| Isostearic Acid | 0.1%(wt.) in 50/50(vol.) 2-Propanol/Dist. Water | 120° |
| CARBOXYLIC ACID SALTS | | |
| Hexadecanoic Acid ($NH_4$+) | 0.1%(wt.) in Dist. Water, pH = 10. (60° C.) | 115° |
| Hexadecanoic Acid (Na+) | 0.1%(wt.) in Dist. Water, pH = 10. (60° C.) | 100°* |
| Hexadecanoic Acid (K+) | 0.1%(wt.) in Dist. Water, pH = 10. (60° C.) | 120° |
| Octadecanoic Acid ($NH_4$+) | 0.1%(wt.) in Dist. Water, pH = 10. (60° C.) | 115° |
| Octadecanoic Acid (Na+) | 0.1%(wt.) in Dist. Water, pH = 10. (60° C.) | 125°* |
| Octadecanoic Acid (K+) | 0.1%(wt.) in Dist. Water, pH = 10. (60° C.) | 120° |
| Oleic ($NH_4$+) | 0.1%(wt.) in Dist. Water, pH = 10. (60° C.) | 90° |
| Oleic (Na+) | 0.1%(wt.) in Dist. Water, pH = 10. (60° C.) | 90° |
| Oleic (K+) | 0.1%(wt.) in Dist. Water, pH = 10. (60° C.) | 69°* |
| METAL SOAPS (WITCO) | | |
| Aluminum Stearate No. 18 | 0.1%(wt.) in Toluene | 90° |
| Magnesium Stearate D | 0.1%(wt.) in Toluene, (77° C.) | 96°* |
| Sodium Stearate T-1 | 0.1%(wt.) in Toluene, (77° C.) | 86°* |
| Calcium Stearate | 0.1%(wt.) in Toluene, (110° C.) | 78°* |
| ANIONIC SURFACTANTS (ROHM & HAAS) | | |
| TRITON W-30 (Sodium Alkylaryl Ether Sulfate) | 0.1%(wt.) in Dist. Water | 70°* |
| TRITON QS-44 (Phosphate Ester-Acid) | 0.1%(wt.) in Dist. Water | 95°* |
| HYDROCARBON WAXES | | |
| Tetracosane | Hexane | 90°* |
| ETHOXYLATED CARBOXYLIC ACIDS (GLYCO) | | |
| Pegosperse 100-0 (Oleic Acid + 2 E. O.) | 0.1%(wt.) in 50/50(vol.) 2-Propanol/Dist. Water | 98°* |
| Pegosperse 400 DS (Diester of Stearic Acid + 8 E. O.) | 0.1%(wt.) in 50/50(vol.) 2-Propanol/Dist. Water | 98°* |
| CARBOXYLIC ACID ANHYDRIDES (MILLIKEN CHEMICAL) | | |
| Octadecenyl Succinic Anhydride | 0.1%(wt.) in 50/50(vol.) 2-Propanol/Dist. Water (66° C.) | 88°* |
| Tetradecenyl Succinic Anhydride | 0.1%(wt.) in 50/50(vol.) 2-Propanol/Dist. Water (66° C.) | 88°* |
| Dodecenyl Succinic Anhydride | 0.1%(wt.) in 50/50(vol.) 2-Propanol/Dist. Water (45° C.) | 89° |
| Isomerized Dodecenyl Succinic Anhydride | 0.1%(wt.) in 50/50(vol.) 2-Propanol/Dist. Water (45° C.) | 99°* |
| INORGANICS | | |
| Sulfur (Elemental) | 0.1%(wt.) in toluene (110° C.) | 69°* |
| POLYMER (MONSANTO) | | |
| Polyvinyl Butyral (BUTVAR ® B-76) | 0.5%(wt.) in toluene | 85°* |
| POLYMER (ROHM & HAAS) | | |
| Acrylic Resin (ACRYLOID ® B-44) (in solution) | 1.0%(wt.) in toluene | 80°* |

In general, hexadecanoic and octadecanoic acids may be preferred over their acid salts, because, among other things, the relatively inferior solubility of these salts can make uniform application difficult.

The ammonium and potassium salts are particularly preferred among the preferred acid salts listed. The preferred metal soaps are all salts of stearic acid using either aluminum, magnesium, or calcium cations, and were all supplied by Witco Chemical Co., 277 Park Avenue, New York, N.Y. 10017.

The preferred anionic surfactants listed are products of Rohm & Haas, Independence Mall West, Philadelphia, Pa. 19105. While the observed wetting angle of the phosphate ester was relatively high, it is thought that a phosphate residue may develop if the material is repeatedly removed and reapplied, as where the printing plate is reconfigured frequently.

Tetracosane is preferred hydrocarbon wax which was applied by dipping a shim in the hexane solution and merely allowing the hexane to evaporate. While the resulting applied layer was substantially thicker than the other materials, tetracosane still exhibited a satisfactory contact angle and is believed quite suitable for use in printing applications where a thicker layer of material would be advantageous.

The listed preferred ethoxylated carboxylic acids are products of Glyco, Inc., 51 Weaver St., P.O. Box 700, Greenwich, Conn. 06830.

The preferred carboxylic acid anhydrides listed are the reaction product of olefins and maleic anhydride, and are manufactured by Milliken Chemical, P.O. Box 817, Inman, S.C. 29349.

Elemental sulfur is an example of a preferred inorganic or non-carbon containing material which may be used to form a hydrophobic layer.

Polyvinyl butyral is an example of a suitable polymeric material is preferred. The sample used is marketed under the name Butvar B-76, a product of Monsanto Plastics and Resins Co., St. Louis, Mo. 63166.

The acrylic resin ACRYLOID B-44, distributed by Rohm & Haas, Philadelphia, Pa., is another example of a preferred polymeric material.

Returning now to the features of FIG. 1, roll 10 passes roll stack 22 or similar means for assuring that a thin, uniform layer of the chosen hydrophobic layer material is being applied over the entire roll surface. For purposes of explanation, if roll 10 were subjected at this point in the process to applications of fountain solution and oleo ink via roll stacks 40 and 50, respectively, roll 10 would print solid ink.

In the embodiment shown, arranging the hydrophobic layer material on roll 10, thereby forming a latent image, is achieved by an imaging means which removes, e.g., by ablation, selected portions of the hydrophobic layer in a desired image-complementary configuration, thereby rendering those areas relatively hydrophilic. Any suitable energy means may be used as an imaging means to remove the hydrophobic layer material in the manner intended. There is no requirement that the energy means be sufficiently powerful to change the nature of the underlying roll surface. In fact, it is generally advantageous that the nature of the underlying hydrophilic material remain substantially unchanged, and it is an advantage of the invention that such change is generally unnecessary. The generally preferred energy levels are therefore those levels which are sufficient to remove the necessary quantities of hydrophobic layer material, without substantially affecting the hydrophilic material thereunder, excepting possible minor pitting, etc. It is thought that, by removing portions of the hydrophobic layer, a portion of the underlying hydrophilic material is at least partially or more nearly exposed, thereby creating an area which can be wetted preferentially by an aqueous developer material such as a fountain solution or an aqueous ink. It is observed that, upon selective removal of at least portions of a hydrophobic layer which coats the underlying intrinsically hydrophilic roll surface, a latent image is generated, presumably defined by contiguous hydrophilic and hydrophobic regions respectively formed by the partially exposed portions of underlying roll surface and the intact portions of the hydrophobic layer. It should be noted that, unlike systems of the prior art, no wash step or developing step, using water, solvents, toners, or any other materials is necessary to establish this latent image on the roll surface. Additionally, it should be noted that the formation of the latent image does not depend upon any photo-induced reaction, for example polymerization, cross-linking, or indeed any kind of chemical reaction as would be used to harden, soften, or otherwise "cure" a hydrophilic or hydrophobic layer, or render such layer either soluble or insoluble during a conventional post-exposure wash step or development step, as might be commonly done in systems of the prior art.

Figure 6:
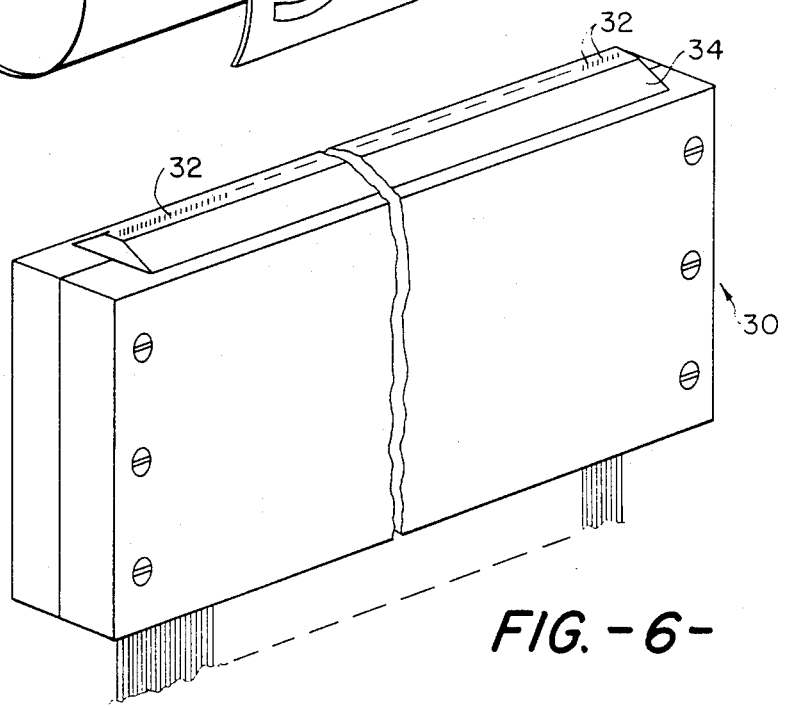
FIG. 6 schematically depicts a stylus bar, comprised of individually addressable styli, of a type suitable for imaging printing plates herein described according to the teachings herein.

Various energy means may be employed as the imaging means to remove portions of the hydrophobic layer material from the surface of roll 10. In the apparatus of FIG. 1, a stylus array is used, such as the one depicted in FIG. 6, although electrode configurations other than a stylus may be used. Stylus array 30 is a spaced array of individually insulated and individually computer-addressable electrodes or styli 32 which are arranged generally perpendicular to and uniformly equidistant from the electrically conductive surface of roll 10, within an insulating form 34. The adjacent styli spacing and total number of wire styli are functions of the desired effective printing gauge—if relatively fine, detailed lettering is desired, a high stylus density is necessary. If stylus density is so high that mutual interference between adjacent styli results and inter-stylus definition is lost, several separate, closely adjacent stylus arrays of more widely spaced styli may be used in a staggered, overlapping configuration. In place of a full-width stylus array, one or more styli may be positioned in close proximity to the roll surface and sequentially traversed across the roll face as the roll is incrementally rotated, thereby allowing the roll surface to be imaged without the use of a full width array of styli depicted in FIG. 6. If an imaging means which is not suitably selectively addressable is used, a mask, stencil, overlay, or the like, as depicted at 36 in FIG. 6 may also be used to block selectively the unintended removal of the hydrophobic layer material; use of such a mask, interposed between the imaging means and the plate surface or the hydrophobic layer thereon, may reduce the need for direct computer control by allowing use of, for example, an array of continuously energized styli or other broad coverage electrode configuration sweeping the entire image area. Such array would only remove portions of the hydrophobic layer material in areas not blocked by the mask or stencil.

Imaging of the coated roll surface by the embodiment depicted in FIG. 1 is achieved by establishing an electrical potential of several hundred volts between the roll surface and one or more selected styli in the stylus array, thereby causing a spark discharge to occur between the respective tips of the selected styli and the roll surface. The energizing electrical signals are routed to the selected individual styli in an image-related configuration. The term image-related is used to mean either an image (i.e., ink-carrying) or image-complementary configuration, and merely indicates that, regardless of the type ink used, the hydrophilic and oleophilic areas of the plate are arranged in a configuration from which the desired ink image may be produced. Image configuration is generally used with an aqueous ink (the ink conforms to the hydrophilic areas of the plate), while an oleo ink requires imaging of the complement of the desired ink image (the ink is made to conform to the hydrophobic area). FIG. 1 depicts use of an oleo ink; therefore, the desired image configuration is image-complementary.

The duration, polarity, and waveform of such signals may be tailored to the particular application and apparatus. The source of such signals, not shown, may be a digital computer or other source of electronically-generated imagery. Generally speaking, direct current signals at moderate voltage levels (300–1000 volts) and low current levels (less than 10 milliamps) have been found to be satisfactory. To avoid charge accumulation on the roll surface and accompanying loss of potential, the surface of the roll or plate may have relatively low electrical resistance. Also, the polarity of the energizing signal may be periodically reversed. Introduction of an inert gas in the arc region such as argon, neon, helium, or combinations thereof, by means of conduit 26 in FIG. 1 or by other means, is helpful in reducing the required breakdown voltage and in minimizing electrode erosion. A gas comprising 10% helium and 90% neon has been used with success. Other, more expensive spark chamber-type gases may be used as well to further reduce the voltage levels required.

Where rapid imaging of roll 10 is desired, it may be difficult to initiate the necessary electrical discharge without a substantial time delay between application of the requisite voltage level and the initiation of the electrical discharge. This is thought to be due to the lack of instantaneous availability of free electrons to initiate the avalanche condition necessary for discharge to occur. It has been found that, by "seeding" the region in which the discharge is to take place with charged particles, as from a corona discharge device, as depicted at 28 in FIG. 1, this time delay can be substantially reduced. An ultraviolet light source may also be employed in place of a corona discharge device.

Figure 10:
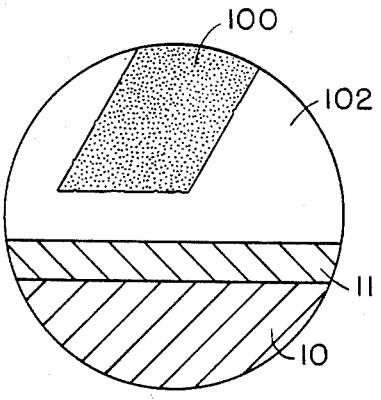
FIG. 10 schematically depicts a magnified perspective cross-section of an imaged planographic plate surface.

The resulting image plate is schematically depicted in FIG. 10, in a magnified perspective view, wherein roll 10 is supporting hydrophilic plate 11 on which is defined an area 100 carrying a hydrophobic layer and an area 102 which is the exposed surface of plate 11. As will be explained hereinbelow, a hydrophilic protective layer may be applied directly to the surface of plate 11 in area 102, and which may optionally extend within area 100.

Figure 4:
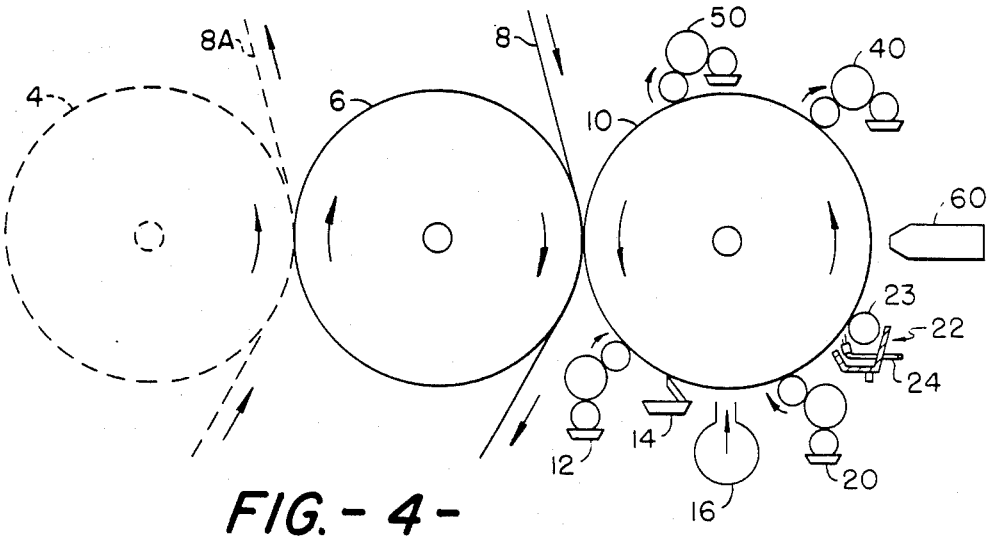
FIG. 4 schematically depicts a printing system similar to FIG. 1 in which a laser has been substituted for the electric spark discharge means.

An alternative embodiment of this invention, employing a beam of electromagnetic energy as an energy means, is substantially depicted in FIG. 4. In the embodiment shown, the energy of one or more incident laser beams from laser system 60 is substituted for the spark discharge described above, these beams being modulated or otherwise allowed to selectively impinge on the layer of hydrophobic layer material with sufficient energy to cause selective ablation of portions of the hydrophobic layer in the desired image-related configuration. One or more such beams may be electronically modulated and, if necessary, traversed over the plate surface. It is foreseen that laser system 60 may be an array of closely spaced lasers, arranged in a pattern analogous to the electrical styli discussed above. As before, no photo-induced chemical reaction is believed to contribute in any significant way in this imaging process. Examples VIII and IX were conducted to demonstrate the use of a laser beam to generate an image on an intrinsically hydrophilic sheet having a hydrophobic layer thereon; it is believed the imaged sheet of these examples could, if installed on a suitable press, be used as a printing plate. Other suitable sources of electromagnetic energy may also be used, so long as the energy directed onto the hydrophobic layer is sufficient to cause removal of portions of the layer in the desired image-related configuration. A stencil, mask or the like may be interposed between the energy source and the plate, as discussed herein in connection with other imaging means, if desired. Such a mask or stencil would be advantageous if, for example, the laser or other beam could not be suitably modulated to allow proper formation of a satisfactory image.

It is also foreseen that other means for removing the hydrophobic layer may be used. For example, one or more jets of heated air or other fluid, controlled, for example, by electrically actuated valves, may be positioned to direct a stream or streams of heated fluid onto the layer, thereby selectively removing at least portions of the layer in the desired image-related configuration, for example, by vaporization or evaporation, and at least partially exposing the hydrophilic material lying thereunder. In certain applications, a group of well defined, focused streams may be arranged into one or more arrays positioned and/or actuated to impinge upon the hydrophobic layer in the correct sequence to generate the desired latent image. One or more individual streams may also be employed, with a means for actuating or modulating and traversing or otherwise positioning the streams relative to the hydrophobic layer to form the desired latent image. In other applications, it may be advantageous to employ one or more relatively unfocused fluid streams which are directed through a stencil, mask, or the like which is interposed between the jets and the plate or the hydrophobic layer thereon. The stencil or mask would be used to assist in directing the fluid streams to the appropriate areas on the hydrophobic layer and to prevent significant unintended removal of the hydrophobic layer material.

Prior to the application of an oleo ink, and following the selective removal of portions of the hydrophobic layer from the roll in image-complementary configuration, an aqueous developing material, for example, a conventional aqueous fountain solution, is applied to the roll surface, by roller stack 40 or other suitable means. It is generally recommended that the fountain solution contain gum or the like in amounts commonly found in commercial preparations. If, however, a shortened plate image life is desired, as, for example, where the plate is frequently re-imaged with a different image, distilled water or other aqueous liquid may be used as a fountain solution. In either case, the fountain solution adheres to the areas from which the hydrophobic layer material has been removed, forming an image on the roll surface which is the complement of the desired oleo ink image.

To enhance the durability of the hydrophilic areas of the image plate, a gum-containing formulation optionally may be applied to the plate after the imaging step and prior to the application of fountain solution. As discussed earlier, the gum is attracted to the exposed hydrophilic areas and tends to form a protective coating over these hydrophilic areas which is itself hydrophilic. This effectively extends the life of the image on the plate. The gum formulation may be applied by any convenient means in any conventional manner. Customarily, the application of such gum formulation is accompanied by a water wash step in which excess gum is removed. In many cases, a fountain solution containing gum, is allowed to remain momentarily on the imaged plate, is sufficient for use in this gumming step.

Following the application of fountain solution, a layer of an oleo marking material such as an oleo ink is then applied in a conventional manner to the roll surface by roller stack 50 or other suitable means; as is expected in lithographic-type printing systems, the oleo ink adheres only to those areas of the roll surface which are not covered by the aqueous fountain solution. As shown in FIG. 1, the roll surface may then be pressed directly against the moving surface of substrate 8 via impression roll 6; alternatively, roll 6 may be an offset or blanket roll 6 by which means the inked image is transferred to the moving surface of substrate 8A, as in conventional offset printing technology. Other intermediate transfer devices such as belts, etc. may also be employed. Substrate 8 or 8A may be comprised of paper, a textile material, or any other suitable material. Any suitable means for moving substrate 8 or 8A may be employed. If desired, the inked image may also be fixed on the roll surface, without subsequent transfer to a substrate.

Figure 5:
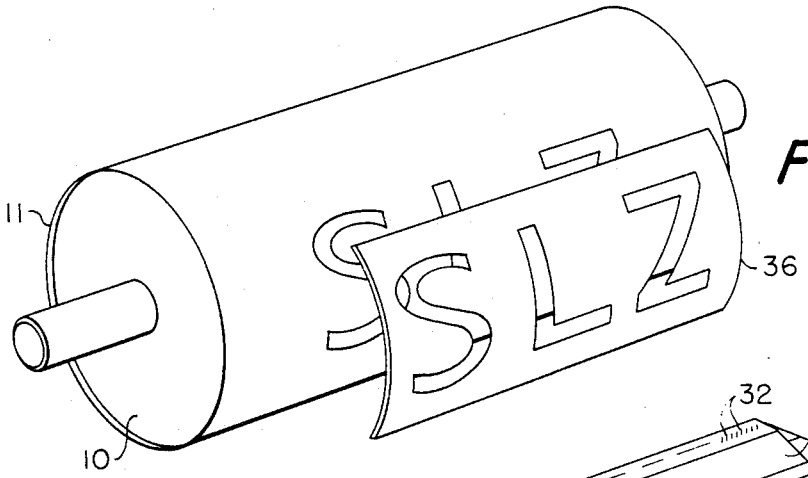
FIG. 5 schematically depicts a plate, attached to a plate roll, embodying the teachings herein, as well as a mask which may be used in imaging the plate.

In those cases where a plate roll is used, and preferably where the roll surface is not merely supporting a separate printing plate, but is in fact acting as the printing plate itself, or where another endless surface such as a belt is used to provide the plate surface, an image may be formed in a continuous manner around the entire perimeter of the roll or belt, with no gap or seam in the plate surface to produce a corresponding gap or seam in the printed substrate. The printed image length need not be confined to the length of the plate surface or to an integral divisor of the plate roll or belt circumference, as is necessary in conventional rotary systems. The image length may in fact exceed the plate roll circumference, or the plate roll circumference may be some non-integral multiple of the image length, due to the fact that portions of the image can be continuously erased and reformed on the roll or belt at the same time a previously formed portion of the image on another side of the roll or belt is being printed. Of course, rather than having the actual roll surface serve as the printing plate, a separate thin, perhaps disposable, sheet of intrinsically hydrophilic material as discussed above may be secured to the perimeter of the roll; this thin sheet of material, superficially resembling a conventional lithographic plate, would then serve as the ink image transfer surface rather than the roll surface as described hereinabove. This separate sheet could take the form of a continuous hollow cylinder or sleeve 11 which is secured to the plate roll 10, as depicted in FIG. 5, or could alternatively resemble a conventional lithographic printing plate. Also depicted in FIG. 5 is a mask 36 which may be employed in an imaging process. Obviously, imaging around the entire circumference of such plate would not be possible unless such plate in fact extended completely around the plate roll.

A principal application of the teachings herein is in the generation of a plate which is imaged on time, and then run without further re-imaging for a relatively large number of plate impressions. Metals which are preferred in this application include nickel, copper, tin, brass, zinc, titanium, zirconium, aluminum, stainless steel, palladium, platinum, lead, and gold. The use of gum preferably in a separate gumming step to protect the hydrophilic areas of the plate is recommended in this application.

A second application of the teachings herein is the printing of images wherein the plate is sharpened or refreshed, i.e. the hydrophilic nature of the hydrophilic areas of the printing plate is rejuvinated. This may require nothing more than energizing the imaging means (e.g., electrical styli or other ablation means) at the appropriate time in the printing cycle and in registry with the original image, after most of the ink and fountain solution have been removed from the plate, and thereby removing any scumming (i.e., ink or other undesirable material) present in the hydrophilic or non-ink areas of the plate.

It is also possible, however, and recommended in many situations, particularly if excessive scumming is noted, to clean the roll or plate down to its intrinsically hydrophilic surface, recoat the surface with an absorbed layer of hydrophobic layer material, and image the roll or plate with either the same or a different (i.e., a reconfigured) image after a pre-determined number of revolutions of the roll. This can be regarded as a third application of the teachings herein—the periodic complete re-imaging of the plate, with either the same or a totally different, reconfigured image, during each revolution or after a selected number of revolutions, of the plate roll.

Where complete re-imaging of the roll or plate with a reconfigured image is desired, one may wish to remove the residual ink and hydrophobic layer material previously applied before applying a fresh layer of the hydrophobic layer material. A conventional roll cleaning means may be used to remove the ink and fountain solution which has not transferred to the substrate; alternatively, the press may be run without ink re-supply until most or all of the ink on the plate has been depleted, and then run without fountain solution re-supply. An additional cleaning means may be helpful in removing the hydrophobic layer material carried by or absorbed on the roll or plate, as well as any gum formulation which may have been applied to enhance the durability of the image. This additional cleaning means may simply take the form of an additional imaging means, e.g., a stylus array to which a lithographically "blank" pattern (i.e., resulting in a totally hydrophilic roll surface) may be directed, thereby requiring all styli to become energized.

It is suggested that, in many applications, a single imaging means may be used for both imaging and cleaning. Referring to FIG. 1, the roll cleaning process would involve two sequential revolutions of roll 10, with roll 6 appropriately disengaged. During the first revolution, ink is cleaned off the surface of roll 10 by means of roll cleaning and drying elements 12, 14, and 16, but the hydrophobic layer applicator 20 and roll stack 22 are disengaged, so that no hydrophobic layer material is applied prior to the passage of the roll surface past the imaging means 30 during this revolution. The imaging means 30 is energized with a totally blank pattern, thereby effectively cleaning the roll surface, i.e., substantially removing all significant surface contamination, including hydrophobic layer material and gum which may remain on roll 10 from a prior imaging step. For best results, it may be necessary to use energy levels somewhat higher than would be used or preferred for normal imaging purposes, or to reduce the speed of the roll surface during this cleaning step.

After passing the imaging station, the surface of roll 10 is now free of ink, fountain solution, hydrophobic layer material, gum formulations, and any contaminants or foreign matter, and is dry and entirely hydrophilic. The fountain solution and inking applicators 40 and 50 are also disengaged. The hydrophobic layer applicator 20 and doctoring means 22 are then engaged, resulting in the application of a continuous, uniform layer of hydrophobic layer material to the clean, hydrophilic roll surface. The imaging, optional gumming, dampening, and inking steps are then performed with roll 6 now pressing against plate roll 10.

If sharpening of an existing image without the application of additional quantities of hydrophobic layer material is desired, the imaging means 30 alone may be used to remove, in registry, assorted material from the hydrophilic areas of the plate, and thereby reduce scumming. For best results, most of the ink and fountain solution on the plate should be removed or allowed to become depleted before the plate is re-imaged by imaging means 30. Additional energy may be required if excessive material such as gum, etc., must be removed.

Figure 2:
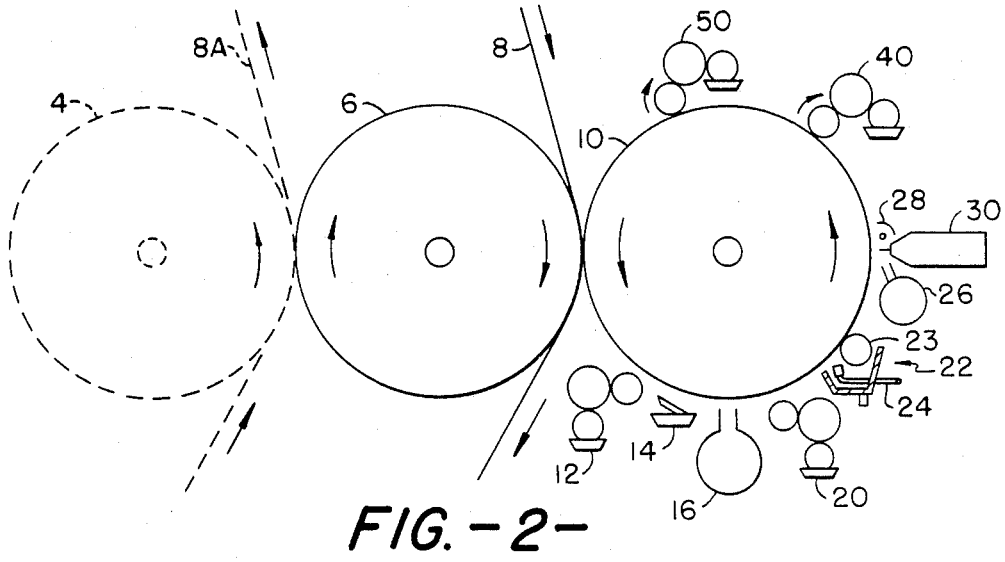
FIG. 2 schematically depicts the printing system of FIG. 1 wherein the plate is not being erased and re-imaged, but is being used to make a series of impressions or copies on a web substrate of the existing image on the plate.
Figure 3:
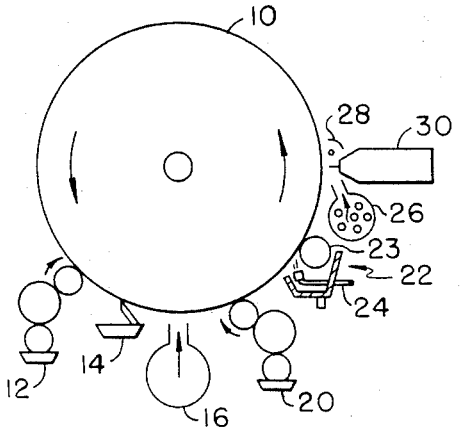
FIG. 3 schematically depicts an apparatus which may be used to image a plate in accordance with the teachings herein.

In the embodiment shown in FIG. 2, it is assumed that, unlike the embodiment of FIG. 1, the image on the roll surface is not replaced or sharpened at selected revolutions of roll 10. Instead, the roll surface is imaged, and multiple copies of that image are printed with no re-imaging. The initial revolutions of roll 10 may be used to clean and image the surface of roll 10, as discussed above. During this time, fountain solution and inking applicators 40 and 50, and roll 6, may be temporarily disengaged. If the hydrophilic roll material tends to become contaminated with hydrophobic contaminants upon exposure to the atmosphere, the imaged roll may be gummed, i.e., coated with a formulation containing gum or the like, to establish a hydrophilic coating over the hydrophilic areas of roll 10. Optionally, this coating may be dried before inking and printing. If done promptly following the imaging of roll 10, for example, and before any printing is attempted, this coating will prevent the exposed portions of the roll surface from becoming contaminated or undergoing undesirable chemical reactions with the atmosphere, and will have the effect of preserving the hydrophilic nature of those portions of the surface of roll 10 from which the hydrophobic layer material has been removed, thus contributing to a more durable image on the plate. In the embodiment shown in FIG. 2, this coating step may be accomplished by relying upon the gum arabic or the like in the fountain solution, i.e., by engaging fountain solution stack 40 immediately following the imaging of the surface of roll 10, with ink stack 50 and the roll cleaning devices 12 and 14 disengaged, and, optionally, with solvent drying jets 16 in operation. This would require a full revolution of roll 10 during which fountain solution containing gum would be applied to the freshly imaged roll surface and optionally dried, nothing more. Alternatively, a separate gum-containing formulation may be used, applied by means of an appropriate applicator not shown in FIG. 2, e.g., a roll stack and doctoring roll, positioned immediately after stylus array 30 and ahead of fountain solution applicator 40. To further render the plate more wear resistant, oleotype laquer may also be applied in the presence of water, which allows the laquer to adhere only to the hydrophobic areas.

After the desired image is placed initially on the surface of roll 10 and any steps thought necessary are taken to avoid potential oxidation or contamination of the exposed hydrophilic surfaces, or to extend the life of the image, the apparatus used (a) to clean the plate (i.e., solvent roll stack 12, doctor blade 14, and solvent drying jets 16), (b) to apply the hydrophobic layer material (i.e., applicator 20 and roller stack 22), and (c) to image the resulting hydrophobic layer (i.e., stylus array 30, gas conduit 26, and corona discharge device 28), are all temporarily rendered inoperative. With these elements (a)–(c) temporarily disengaged, the resulting system superficially resembles a conventional printing system, in which a fountain solution is applied (via roll stack 40) to a surface bearing an image defined by hydrophilic and hydrophobic areas, which in turn causes the oleo ink applied subsequently by roll stack 50 to adhere to the roll surface only where the hydrophobic areas repelled the fountain solution. This inked image is then transferred to a substrate as before, using roll 6 as an impression cylinder, or as an offset roll. The inked roll is then replenished with fountain solution and ink, via roll stacks 40 and 50, respectively, and the process repeated. Like the embodiment of FIG. 1, and unlike conventional printing systems, however, the hydrophilic areas are formed by the partially exposed roll or plate surface, optionally coated with gum, and the hydrophobic areas are formed by a single thin layer of hydrophobic layer material which is selectively removed from the roll surface without the use of light-sensitive coatings, without any discernible polymerization, cross-linking, or other chemical change to the material in the hydrophobic areas, and without the need for any wash or developing steps.

As suggested above, after imaging, the plate may be used in a conventional manner, with conventional fountain solutions, inks, etc. It is therefore contemplated that a thin sheet of hydrophilic material as described above and cut to appropriate dimensions may be coated and imaged as disclosed herein, and placed in a conventional printing press to generate the multiple printed copies desired. See Examples I–VI. The device depicted in FIG. 3, similar to the device of FIG. 1 but less the equipment necessary for actual printing of the image (e.g., roll stacks 40 and 50, etc.), may be used for the plate generation and imaging steps independent and apart from the actual printing process, which process may be done on separate, conventional equipment, long after the imaged plate is made.

Figure 7:
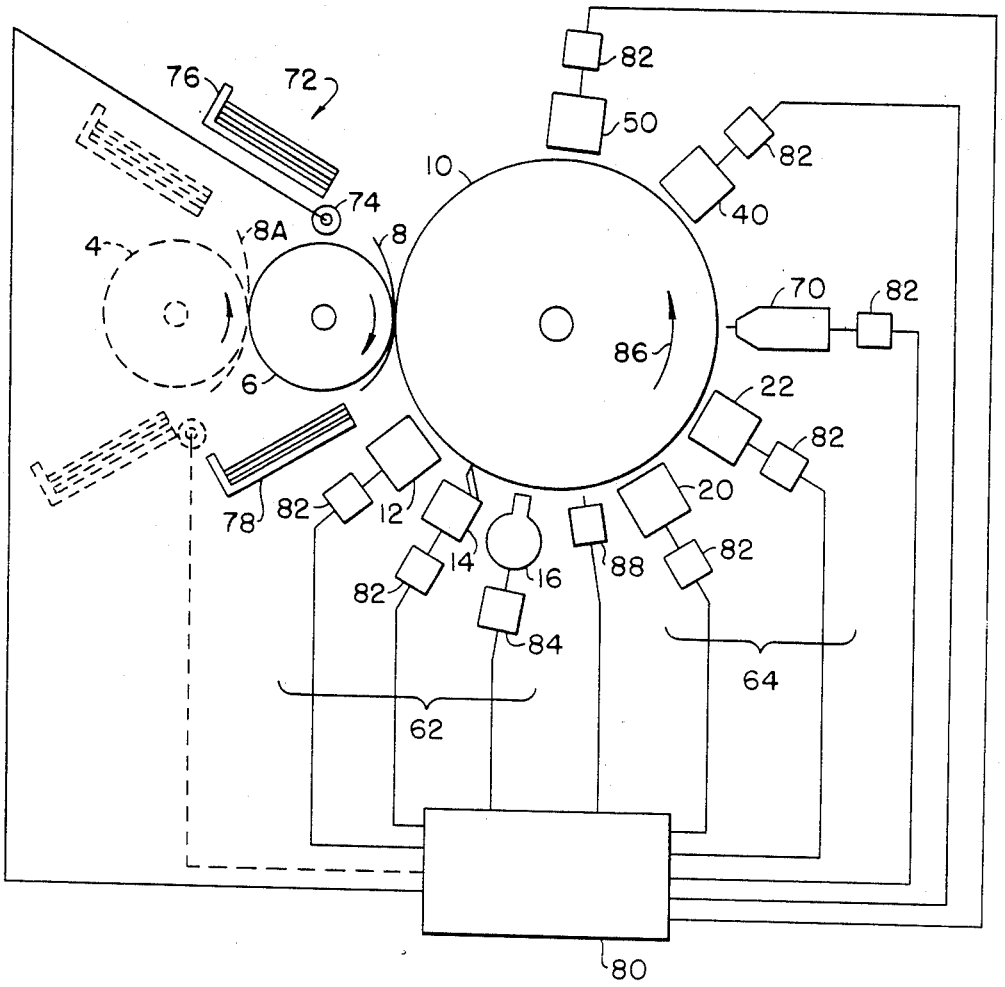
FIG. 7 schematically depicts a rotary lithographic-type printing system employing a control system for correctly sequencing and controlling a variety of operations directed to imaging, re-imaging, or printing an image on a substrate according to the teachings herein.

Having thus outlined several embodiments of printing apparatus and processes, and described various sequences of operation, reference is now made to FIG. 7 showing a further embodiment. Unless otherwise noted, elements similar to those previously described have been given the same reference numerals and serve the same functions. In the embodiment shown, the plate comprises an endless surface in the form of a roll 10, which rotates in the direction of arrow 86. Other forms of endless surfaces could be employed, for example, belt-type ink transfer surfaces arranged about a plurality of rolls. Various subsystems, previously described, are arranged about the ink transfer surface along its direction of movement. These subsystems comprise: the cleaning subsystem 62, made up of elements 12, 14 and 16; the hydrophobic layer application subsystem 64, made up of elements 20 and 22; the latent image generating subsystem, which may be generalized here as newly numbered element 70; the aqueous fountain solution application subsystem comprising element 40; the inking subsystem comprising element 50; and the image transfer subsystem comprising element 6, and, if desired, element 4.

In the discussion of previous embodiments, the substrate to which the ink image is transferred comprises a web. However, in accordance with conventional practice, the substrate can comprise either a web or individual sheets as desired. In the embodiment of FIG. 7, individual sheets are fed seriatum to the transfer station 6 by a sheet feeder 72 of any desired conventional design, as, for example, feed rolls 74 and bin 76. The feed roll 74 removes the sheet from the bottom of the stack and feeds it to the transfer roll 6 wherein the ink image is transferred to the substrate surface 8. The substrate is then fed to the output bin 78 wherein it is stacked until removal by a machine operator. In the alternative, if roll 6 is used as an offset roll, the ink image is transferred onto roll 6 rather than onto a sheet between roll 6 and roll 10. The ink image is then re-transferred from the roll onto sheet 8A which is fed by a sheet feeder (shown in dotted lines) similar to the sheet feeder 72. Element 72, 74, 76, and 78 may be regarded as comprising optional elements of the image transfer subsystem. The latent image generating subsystem 70 can be any suitable means, as discussed hereinabove, i.e., a electrical spark discharge system, one or more beams of electromagnetic energy, one or more heated fluid streams, etc., and includes a source of image-forming signals, such as a digital computer.

In a preferred approach, the latent image generating subsystem 70 may be utilized in both forming the latent image and in re-imaging the roll surface. Alternatively, however, a separate re-imaging subsystem 88 may be employed. The separate subsystem 88 can comprise a spark discharge means or any other means as previously discussed in reference to the latent image generating station 70, and may be arranged, for example, between the cleaning subsystem 62 and the hydrophobic layer application subsystem 64. A primary function of re-imaging subsystem 88 is to clean the surface of roll 10 by removing hydrophobic layer material, gum, etc., which may be present. This is achieved by "imaging" the entire plate, resulting in a lithographically blank, i.e., totally hydrophilic, plate.

Each of the subsystems is selectively operable and their respective operation is controlled by a control system 80. The cleaning roll stack 12 and the doctor blade 14 are secured by moving them toward and away from the ink transfer surface by means of mechanical actuators such as solenoids or motors with screw drives 82. Similar actuators 82 are also employed for moving toward and away from the ink transfer surface the hydrophobic layer application subsystem 64, the latent image generating subsystem 70, the fountain solution application subsystem 40 and the inking subsystem 50. Actuation of transfer roll 6 can be controlled by controlling the sheet feeder 72 or, alternatively, the transfer roll 6 can be moved out of engagement with the ink transfer surface by conventional means. The drying jets 16 are controlled by means of electrically operated valves 84. Accordingly, it is possible for the control system 80 to selectively operate any of the various subsystems by energizing the appropriate actuating systems 82, 84 or 72. Each time the ink transfer surface comes within operable proximity to the complete sequence of subsystems, e.g., each time roll 10 makes a complete revolution, may be termed a cycle of operation.

The control system 80 may be implemented in any conventional manner. For example, it is possible to utilize conventional cam and switch arrangements for selectively actuating the respective actuating systems 82, 84 and 72 to provide any desired sequence of operation. Preferably, however, in accordance with more current practice, a digital-type control system would be employed utilizing a programmable computer. The advantage of a digital-type system is that a greater variety of operational sequences can be selected. It is foreseen that the same computer system may serve as both the control system and the source of the electronically generated imagery to be printed.

Such a computer-type controller and associated actuating systems could readily carry out, on a single printing apparatus, all of the various sequencing arrangements needed to fully carry out the teachings herein. For example, assume the system is required to place a latent image on the previously described plate and print multiple, oleo ink copies, using that same image. This mode of operation may be termed "image and run." During a first revolution of roll 10, cleaning subsystem 62 alone may be actuated to remove ink or other material from the surface of roll 10. During the second revolution of roll 10, latent imaging generating subsystem 70 or separate re-imaging subsystem 88 may be employed to clean the roll surface of hydrophobic layer material, gum, etc. which may remain. Such actuation of subsystems 62 and 88 are optional, and may be eliminated if the plate surface is sufficiently clean. Following the optional passage of the roll surface past separate re-imaging subsystem 88, hydrophobic layer application subsystem 64 is actuated, along with latent image generating subsystem 70 and fountain solution application subsystem 64. Ink subsystem 50 and the image transfer subsystem are not actuated, to allow at least one revolution of roll 10 carrying nothing more than a gum-containing formulation residing on an imaged plate. Applying fountain solution in this manner can serve as an optional gumming step to enhance the longevity of the hydrophilic portions of the plate, as discussed earlier. Drying jets 16 may be optionally employed at this point in the process. Of course, if a separate gum-containing formulation is to be used, a separate gum application and water jet wash subsystem 63, schematically depicted at 18 and 19, respectively, in FIG. 8, may be desired. Control system 80 could be modified appropriately to accommodate the addition of such subsystem.

After the image on the plate has been generated and, optionally, gummed, only the fountain solution application subsystem 40, inking subsystem 50, and the image transfer subsystems are actuated, which results in the printing of the same image with each revolution of roll 10.

If a change in the image is desired at this point, several options are available. If a complete re-imaging of the plate is desired and the plate has been gummed, a preferred approach is to begin as above, with the actuation of only cleaning subsystem 62, followed by activation of latent image generating subsystem 70 or separate re-imaging subsystem 88, etc., in order to clean thoroughly the roll surface. If no gum was used, the actuation of these latter subsystems may be unnecessary, and in many cases a fresh layer of hydrophobic layer material may be applied over the existing hydrophobic layer, providing little or no ink remains on the plate. The adsorbed character of the layer, which contributes a self-leveling quality to the material in layer form, along with the method of application, can result in a suitable thickness of material being applied. Following this re-application of hydrophobic layer material, the plate is then imaged, dampened, inked, and the image transferred to the substrate, as before.

It should be noted that the above-described sequences of actuation are but a few of the possible sequences which may be found to be advantageous under various circumstances. Other sequences may be employed, as desired, to achieve improved printing operation.

The previously described process results in a printing plate in which those areas of the hydrophilic plate surface intended to carry an oleo ink are coated with a hydrophobic layer material, while the non-image areas of the hydrophilic plate surface are thought to be at least partially exposed. Where desired, a layer of gum may be made to cover these partially exposed areas, thereby rendering these areas more durably and decisively hydrophilic. The method for generating such a plate described previously may be summarized as follows: (1) coat the hydrophilic plate surface with a thin layer of hydrophobic layer material, (2) selectively remove the layer in the desired configuration, and, (3) as an optional step, coat the resulting plate with gum, the gum ordinarily adhering only to the exposed portions of plate surface. Alternative processes for generating the above described plate, as well as alternative printing plate constructions, however, are possible.

The above plate comprising hydrophobic layer material and gum in contiguous areas may be generated either by selective removal of a uniform layer of hydrophobic layer material, followed by a gumming step, as summarized above, or, for example, by (1) covering the plate surface with a thin layer of gum, (2) removing selectively portions of the gum layer in a desired configuration and (3) coating the resulting plate with a hydrophobic layer material. Many hydrophobic layer materials will not readily cover the remaining portions of the gum layer, but will instead preferentially coat the now-exposed portions of the plate surface. The result is a plate comprising hydrophobic layer material and gum in contiguous areas, as before. Note, however, that (1) the removal step was performed on the gum rather than the hydrophobic layer material, and (2) the removal step involved tracing the complement of the configuration used before.

An alternative method for generating plates similar in general construction to those disclosed above, which also results in the placement of hydrophobic layer material on the plate in an image-related, pre-determined configuration comprises selectively applying the hydrophobic layer material in the appropriate configuration, rather than selectively removing the material from a uniform layer, as has been described above. This method may be implemented using, for example, an ink jet printing assembly or other means which is supplied with a source of hydrophobic layer material of appropriate viscosity rather than ink. Many of the materials listed in Table I are suitable for this application. The ink jet printing assembly may be substituted for the hydrophobic layer application subsystem 64 and the layer-removal portion of the latent image generating subsystem 70 in the apparatus of FIG. 7. In other words, in FIG. 7, the hydrophobic layer application subsystem 64 may be disengaged, and the latent image generating subsystem 70 may comprise an ink jet assembly, or an array of such assemblies, which applies the chosen hydrophobic layer material in the proper configuration. The use of a stencil, mask, or similar device may be used to aid in properly configuring the hydrophobic layer material, as before.

As suggested above, alternative plate constructions are also possible. Where a durably-imaged plate is desired, for example, a suitable plate may be generated by (1) covering the hydrophilic plate surface with a thin underlayer of gum, (2) coating the gum underlayer with a thin overlayer of hydrophobic layer material, and (3) selectively removing the overlayer of hydrophobic layer material in the desired configuration, without substantially disturbing the underlying gum. Depending upon the choice of materials, it has been found that application of the hydrophobic layer material while in the vapor state, and allowing the material to condense onto the gum surface, or heating the hydrophobic layer material prior to application, aids in the formation of the requisite hydrophobic overlayer recited in step (2).

The chemical properties of most gums, particularly their significantly higher molecular weight, allow them to adhere well to exposed portions of the plate surface. In most cases, the gum layer is relatively more difficult to remove and tends to remain intact compared with the hydrophobic layer material, and the imaging energy may be readily adjusted to accomplish this layer-selective removal with many combinations of gum formulations or similar materials and hydrophobic layer materials. The result is a plate wherein the hydrophilic areas are comprised of the hydrophilic plate surface, coated by a layer of gum, and the hydrophobic areas are comprised of the hydrophilic plate surface coated with a layer of gum, which layer in turn is coated with an overlayer of hydrophobic layer material. As suggested above, this same plate construction may be achieved by selective addition of the hydrophobic layer material over the gum in the desired configuration, via an ink jet or other means, rather than selective removal of the material from a uniform overlayer. The use of an ink jet or other selective applicator could also be employed to generate a plate wherein the plate surface is first uniformly coated with a hydrophobic layer material, followed by the selective application of a hydrophilic layer of gum, e.g., by ink jet, in an image-related configuration.

The printing processes described hereinabove have generally assumed use of a substantially planographic printing plate wherein the image areas of the plate comprise regions which are relatively hydrophobic and wherein the non-image or image-complementary areas of the plate comprise regions which are relatively hydrophilic. In conventional lithographic printing processes, an oleo ink is applied to a plate surface which has been selectively wetted, in image-complementary configuration, with an aqueous fountain or dampening solution. The plates used in these processes, however, are also suitable for use in printing systems employing aqueous inks. In their simplest form, such systems may be thought of as lithographic systems in which an aqueous-type ink is made a component of the aqueous fountain solution. Such composite solution may be applied in the same manner and sequence as a conventional fountain solution, e.g., through the use of roll stack 40 or other suitable applicator. No ink is applied via applicator 50, which may be disengaged. The ink carried in the fountain solution is transferred to a substrate as before, i.e., either directly or via an offset roll or the like. Because the ink now resides in the hydrophilic areas, rather than in the hydrophobic, oleophilic areas as before, the image "sense" of the plate must be transposed, i.e., the hydrophobic layer material must now be configured in an image-complementary configuration and the hydrophilic areas of the plate must be in image configuration, rather than vice versa, as before. This means that the electronic image generating means which controls the selective application or removal of the hydrophobic layer material must be modified to impart the desired signals to the imaging means. (As discussed earlier, a more general term, "image-related configuration", may be used to describe the configuration of either the hydrophilic or hydrophobic areas. Alternatively, the latent image may be said to correlate with the resulting ink image, in that one either directly implies or is complementary to the other.) The process of cleaning aqueous ink from the roll may be somewhat different than in the oleo ink case, the hydrophobic layer material should now no longer have an affinity for the printing ink used, and other obvious differences may be found, but the overall printing process, as distinguished from the imaging process, is otherwise substantially similar, and may be used in situations where aqueous inks are advantageous.

Consideration of the alternative processes and plate constructions, and use of aqueous rather than oleo inks, as discussed above, does not change significantly either the manner in which the various plates may be generated, imaged, erased, re-imaged, or used in a printing process, or the apparatus which would be used to effect such operations, in accordance with the processes and apparatus previously described, except in ways which would be readily apparent to those skilled in the art.

Figure 8:
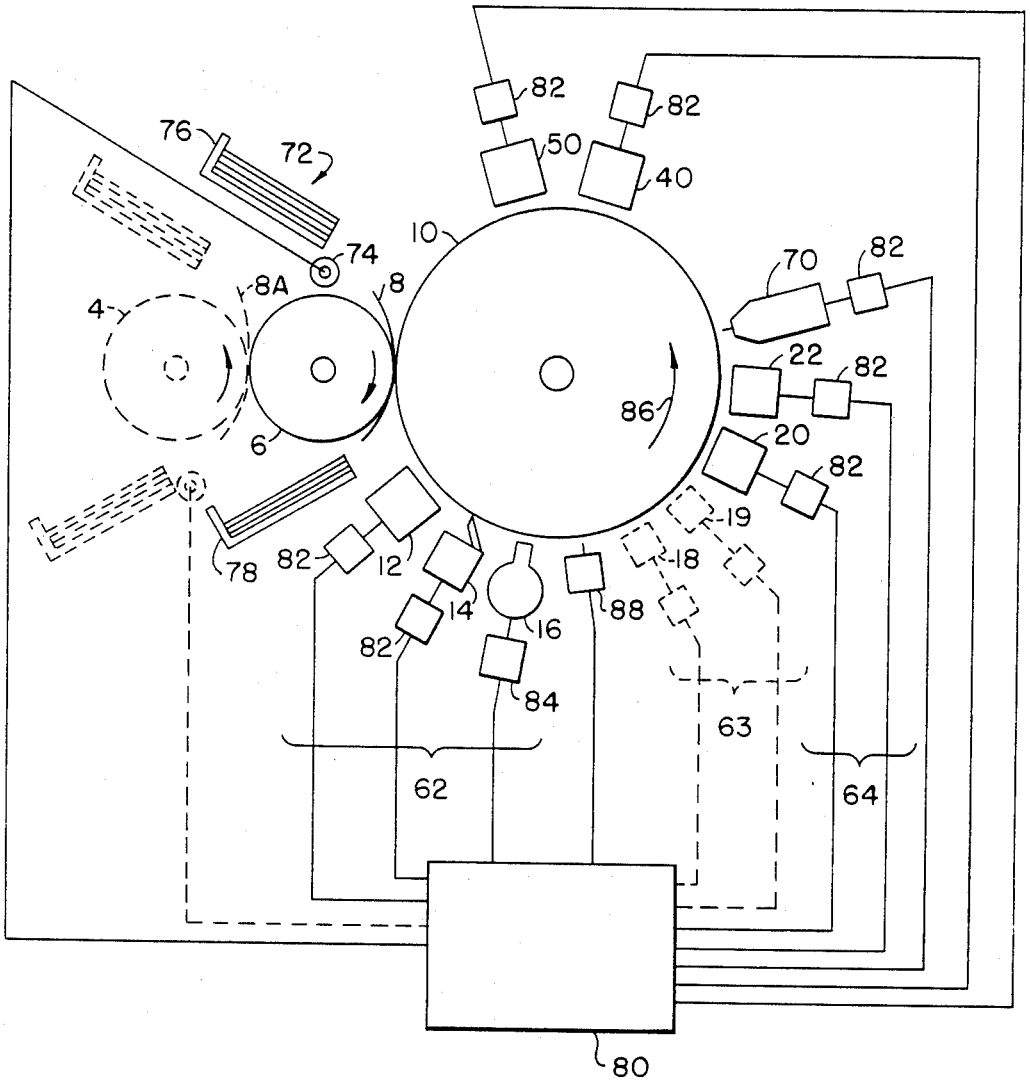
FIG. 8 schematically depicts the system of FIG. 7 which has been modified to include a separate hydrophilic layer applicator.
Figure 9:
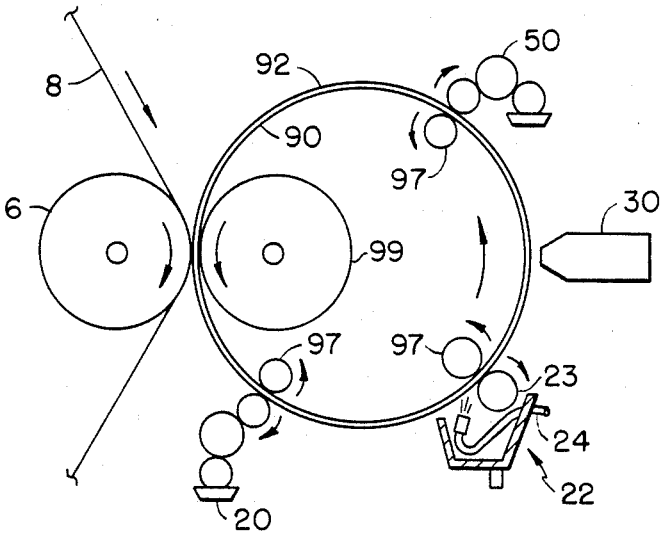
FIG. 9 schematically depicts a printing apparatus in which a reusable cylindrical printing screen is used.

Assume, for example, a durably-imaged plate comprising a complete, specially gummed underlayer and a configured overlayer of hydrophobic layer material is to be generated and run without re-imaging in an apparatus along the lines of that depicted in FIG. 7. The apparatus depicted in FIG. 8 is similar to that depicted in FIG. 7, except that a hydrophilic layer applicator subsystem 63, comprising gum applicator 18 and wash means 19, and appropriate actuators 82, have been added immediately prior to the hydrophobic layer applicator subsystem. The sequence for the previously described "image and run" mode of operation may be followed, except that, immediately prior to the actuation of hydrophobic layer application subsystem 64, hydrophilic layer applicator subsystem 63 is actuated, causing a uniform, thin layer of the gum formulation to be deposited on the hydrophilic surface of roll 10. Optionally, roll 10 may be allowed to revolve one or more times to allow the gum formulation to dry. Following this gum application step, all remaining steps of the "image and run" mode of operation are followed. If aqueous ink, added to the fountain solution, is to be used rather than oleo ink, the principal necessary changes to the above would be (1) disengagement of ink subsystem 50, and (2) adjustment of latent imaging generating subsystem to remove the hydrophobic layer material in image, rather than image-complementary, configuration.

Re-imaging of the plate discussed above is relatively easy, particularly if an aqueous ink is used, due to the uniform, somewhat tenacious layer of gum residing on the plate surface and the ease with which the aqueous ink may be removed via cleaning subsystem 62. Layer-selective removal of the entire layer of hydrophobic layer material is readily accomplished, for example, by activation of re-imaging subsystem 88. Re-application of a gum layer, if necessary, may be accomplished via optional actuation of hydrophilic layer application subsystem 63. The natural self-leveling tendency of gum prevents excessive gum build-up. All the re-imaging steps above, as well as the application of a fresh layer of hydrophobic layer material, followed by re-imaging and printing, could be achieved within a single revolution of roll 10 if desired.

Figure 11:
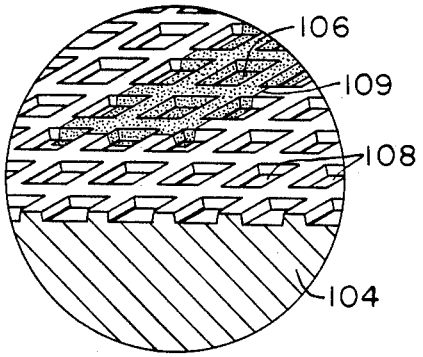
FIG. 11 schematically depicts a magnified perspective cross-section view of a portion of a gravure roll surface which has been imaged according to the teachings herein.

A non-planographic, gravure-type cylinder having a contoured surface which is intrinsically hydrophilic, as discussed herein, may be substituted for the planographic plate roll discussed above, with the benefit of advantages analogous to those discussed above. The physical configuration of the surface may be among those ordinarily chosen by those skilled in the art; the shape at the depressions, cells, grooves, etc., which comprise the contoured surface is not important. The term cell is intended to include all such features. Beginning with a substantially clean cylinder, the desired hydrophobic layer material may be applied either by applying a thin, uniform layer to the cylinder surface and selectively removing, e.g., by ablation, material from the surface of those cells intended to accept an aqueous developing liquid, e.g., an ink, or by selectively applying, e.g., by ink jet methods, a coating or layer of material to the interior surface of the desired cells. It should be noted that, preferably, the material and application means are chosen to permit the application of a monomolecular or near-monomolecular layer of the material which coats the walls and floor, or portions thereof, of the desired cells and conforms thereto. It is not necessary that the hydrophobic layer material fill, to any significant extent, the cell interiors. Treating the cylinder surface with a gum-containing formulation either prior to application of the hydrophobic layer material or after imaging, to enhance the durability of the cylinder image, is optional. FIG. 11 depicts a magnified perspective view of a cross section of the surface of a conventionally configured gravure roll 104 which has been imaged by arrangement of a hydrophobic layer material over its hydrophilic surface. Shaded roll cells 106 carry an adsorbed, thin hydrophobic layer; unshaded cells 108 carry no hydrophobic layer material, and are therefore comprised of the exposed intrinsically hydrophilic material from which the roll is made, or a hydrophilic protective layer such as a gum layer. Boundary 109 indicates that only a portion of an individual cell need carry the hydrophobic layer material.

Once the roll has been thus imaged, printing may be done in accordance with conventional gravure printing practice. Application of an aqueous ink to the cylinder surface, followed by a doctoring step, produces an ink image on the cylinder comprised of the cells which do not contain the hydrophobic layer material. The image is then transferred to a suitable substrate by conventional means, e.g., direct cylinder-to-substrate contact. As discussed above, if an oleo ink is used along with a separate fountain solution and fountain solution applicator, the "sense" of the image on the cylinder must be changed so that those cells intended to carry ink also carry a quantity of hydrophobic layer material.

The resulting gravure cylinder may be easily re-used, i.e., re-imaged, by cleaning ink from the cells and surface of the cylinder using conventional methods, and removing, e.g. by ablation, all remaining hydrophobic layer material or other material from the cells. After thus thoroughly cleaning the cylinder of all dirt, coatings, etc., a fresh quantity of hydrophobic layer material may be applied as before, i.e., either selectively in the desired configuration, or as a uniform layer for subsequent selective removal. It should be noted that, with the invention herein described, the possibility exists to generate half tones by varying the individual intra-cellular area coated by the hydrophobic layer material, i.e., the amount of interior cell surface which is coated with a layer of hydrophobic layer material within individual cells may vary.

The various sequences of cleaning, imaging, printing, re-imaging, etc., and the automated manner in which these processes may be carried out, as discussed above in connection with planographic plates, are equally applicable where a gravure roll is used, except for modifications which will be apparent to those skilled in the art and which are dictated by conventional gravure printing procedures.

The following examples are merely intended to demonstrate some of the preferred embodiments of the present invention, and in no way are intended to limit the scope of the invention.

EXAMPLE I

A five mil (0.005 inch) thick plain stainless steel sheet supplied by the Precision Steel Warehouse, Inc. of Downers Grove, Ill., was placed in a 600° F. oven for five minutes to vaporize any surface contaminants which may have been present on the sheet surface. The sheet was then mounted on a grounded steel plate cylinder. A small amount of a solution comprising 0.2 grams of hexadecanoic acid dissolved in 100 ml distilled water and 100 ml isopropyl alcohol was then wiped by hand onto a four inch by four inch area in the central region of the sheet, thereby rendering that area hydrophobic. The region of the sheet outside the four inch by four inch area remained clean of contaminants, and was therefore substantially hydrophilic.

A linear stylus array comprising tungsten wires approximately 10 mils in diameter supplied by the California Fine Wire Company, of Grover City, Calif., with an adjacent wire spacing of approximately one-half inch, was positioned so that the distance between the wire tips and the stainless steel sheet surface was approximately three mils. The wires were held in an insulating matrix of glass filled epoxy and glass fiber reinforced board. Each wire was connected through a 100,000 ohm resistor and a switch to a +800 volt D.C. power supply. The cylinder carrying the stainless steel sheet was rotated at a circumferential speed of approximately four yards per minute while the switch to the wires was closed, completing the connection with the power supply. The stainless steel sheet was held at ground potential via contact with the grounded cylinder. Argon gas was directed to the region of the wire tips, at a rate of approximately 3 C.F.H. As the sheet surface passed under the wires, electrical arcs occurred between the wire tips and sheet surface, thereby imaging the surface. After a single pass of the sheet under the wires, the switch was opened and the sheet was removed from the cylinder and stored in distilled water, to prevent oxidation or contamination of the clean hydrophilic areas of the sheet traced by the arcs.

Several hours later the sheet was removed from the water and mounted in a Multilith 1250 Offset Lithographic Duplicator (distributed by A M International, Los Angeles, Calif.) in place of a conventionally prepared lithographic plate. The duplicator was inked with Pantone Process Brown ink, (supplied by A M Multigraphics, a division of A M International, Mt. Prospect, Ill.). The fountain solution used was a solution of one part (by volume) 3M Duplicator Fountain Concentrate, supplied by 3M Printing Products Division, St. Paul, Minn., and 31 parts (by volume) distilled water. After mounting the sheet, the duplicator was run in the normal fashion, with the dampening rolls applying fountain solution to the sheet surface, followed by the inking rolls applying ink to the sheet surface. The fountain solution was observed to wet only those areas of the four inch by four inch region where the arcs had impinged. The ink, being immiscible with the fountain solution, coated only the remainder of the four inch by four inch region containing no fountain solution. The rest of the plate, being uncontaminated, wet with the fountain solution and therefore did not accept ink. The inked image was transferred to the blanket cylinder where it was transferred to paper. A clean, sharp, well-defined image resulted on the paper which was the complement of the area traced by the arcs, i.e., a four inch by four inch inked region carrying uninked lines corresponding to the region traced by the arcs. The sheet was used to print multiple copies on paper. No significant image degradation was observed.

EXAMPLE II

The procedures of Example I were followed, except as noted below. A five mil thick plain aluminum sheet, from the same supplier, was used in place of the stainless steel sheet. The sheet was cleaned with alcohol and placed in a 600° F. oven for one minute to vaporize any surface contaminants. After the sheet was imaged, it was removed from the cylinder and a diluted solution of fountain solution (Formula 100 fountain solution, distributed by AM Multigraphics, Mt. Prospect, Ill.) and distilled water in a volume ratio of 1:32 was applied and allowed to air dry. The plate was not stored under water. The next day the plate was mounted on the press, and multiple copies of a clean, sharp, well-defined image were recorded on paper, with no discernible trace of image degradation. Intentional fouling of the hydrophilic areas of the plate with ink resulted in a self-cleaning action by the plate; printing of clean, sharp, well-defined images promptly returned.

EXAMPLE III

A five mil thick plain stainless steel sheet supplied by the Precision Steel Warehouse, Inc. of Downers Grove, Ill., was mounted on the plate cylinder of a Multilith 1250 Offset Lithographic Duplicator, made by A M International, of Los Angeles, Calif., in place of a conventionally prepared lithographic plate. A linear array comprising parallel tungsten wires 10 mils in diameter and spaced 25 wires per linear inch supplied by the California Fine Wire Company, of Grover City, Calif., was positioned so that the distance between the wire tips and the plate was approximately three mils. The wires were held in an insulating matrix of glass filled epoxy and glass fiber-reinforced resin board. Each wire was connected through a 100,000 ohm resistor to a +700 volt D.C. power supply through a switch. Prior to mounting, the surface of the stainless steel sheet had been immersed in a fifty percent (by weight) solution of sodium stearate in distilled water (prepared by heating the mixture to a temperature of about 50° C. and cooling), and then rinsed with streams of distilled water and briefly air dried, leaving the sheet uniformly hydrophobic. The duplicator was inked with O/S H/T Process Blue fifteen percent 23401 ink, made by Sinclair and Valentine Co., of Charlotte, N.C. The fountain solution used was a solution of 31 parts (by volume) water and one part (by volume) RBP Craftsman Fountain Solution Soft No. 290701, supplied by Research for Better Printing Chemical Corporation, Milwaukee, Wis.

With the dampening and inking rollers disengaged from the sheet, the plate cylinder was rotated at a circumferential speed of approximately four yards per minute while the switch to the wires was closed, completing the circuit to the power supply. The stainless steel sheet was held at ground potential via connection with the grounded duplicator frame. Argon gas was directed to the region of the wire tips, at a rate of approximately 3 C.F.H. As the sheet surface passed under the wires, electrical arcs occurred between the wire tips and the sheet surface.

After a single pass of the sheet under the wires the switch was opened, the plate roll speed was increased to twenty yards per minute, and the dampening roll was brought into operative engagement with the sheet. The fountain solution wet only those areas of the sheet where the arcs had impinged. After several revolutions of the plate cylinder in operative engagement with the dampening roll, the inking rolls of the duplicator were brought into operative engagement with the sheet. The ink, being immiscible with the fountain solution, was repelled by those areas wet by the fountain solution, and coated the surface of the sheet only in those areas not wet by the fountain solution, i.e., those areas where the arcs had not impinged. The inked image was then transferred to the blanket cylinder where it was then transferred to paper. A clean, sharp, well-defined image was printed on the paper which was the complement of that image traced by the arcs, i.e., the paper showed a solid inked area with a series of sharp, inked lines corresponding to the regions traced by the arcs. The sheet was used to make multiple copies of the image; no discernible degradation in image quality was observed. The sheet was then cleaned manually with mineral spirits, and the sheet was recoated with the sodium stearate solution and rinsed with distilled water, as before. The imaging and printing processes described above were repeated. Again, the result was a series of clean, sharp, well-defined images of uninked lines traced within a region of solid ink, similar to those obtained earlier. There was no visible trace of the earlier image.

EXAMPLE IV

The surface of a glass roll approximately 4 inches in diameter and comprised of 60% $Al_2O_3$ and 40% $TiO_2$ was first cleaned with isopropyl alcohol and then wiped dry. Then a solution of 50% hexadecanoic acid and 50% isopropyl alcohol (by volume) was applied with a cotton swab, and the excess was washed off with a stream of distilled water, presumably leaving a thin layer. After air drying, the roll was imaged using a 10 mil diameter tungsten stylus, spaced 2.0 mils from the roll surface. An electrical current of 8 milliamps at +800 volts was established in a spark discharge between the roll and the stylus, as the roll turned at a circumferential speed of 4.6 ypm, thereby causing the arc to trace a line on the roll surface. Argon gas was fed into the region of the discharge, at a rate of about 10 C.F.H. and at essentially atmospheric pressure.

A mixture (by weight) of 1 part 3M Duplicator Fountain Concentrate, distributed by 3M Printing Products Division, St. Paul, Minn., and 15 parts of distilled water, was applied to the general area of the roll surface carrying the image and allowed to remain momentarily. A roller was used to apply an additional quantity of the above solution, which was observed to wet only the imaged area. A lithographic-type ink (Offset Black BI8261, manufactured by Burntwood Industried, Inc., of Addison, Ill.) was then applied to the general area of the roll surface carrying the image via a roller. The ink adhered to the roll surface only where the fountain solution had not wet the roll, i.e., in those areas which had not been imaged by the spark discharge. The ink image was then transferred to paper. A sharp, well-defined printed image was observed. Additional quantities of fountain solution and ink were sequentially applied to the general area of the roll surface carrying the image, and the image again transferred to paper. As before, a sharp, well-defined printed image was observed.

EXAMPLE V

A 4"×1" section of five mil (0.005 inch) thick type 304 stainless steel sheet supplied by the Precision Steel Warehouse, Inc. of Downers Grove, Ill., was rinsed with a stream of isopropyl alcohol, air dried, and placed in a 600° F. oven for one minute to vaporize any surface contaminants which may have been present on the sheet surface. The sheet was then dipped in a solution comprising 0.2 grams of hexadecanoic acid dissolved in a solution of 100 ml distilled water and 100 ml isopropyl alcohol and rinsed promptly in cold tap water, thereby rendering the sheet hydrophobic. The sheet was then dried in a stream of nitrogen gas and securely mounted on a grounded, steel cylinder in order to image the sheet surface. A single tungsten wire approximately 10 mils in diameter supplied by the California Fine Wire Company, of Grover City, Calif., was positioned so that the distance between the wire tip and the stainless steel sheet surface was approximately three mils. The wire was held in an insulating sandwich of acrylic plastic. The wire was connected through a 100,000 ohm resistor and a switch to a D.C. power supply adjusted to deliver +800 volt pulses at a frequency of 17 KHz. The cylinder carrying the stainless steel sheet was rotated at a circumferential speed of approximately 1.2" per second while the switch to the wire was closed, completing the connection with the power supply. The stainless steel sheet was held at ground potential via contact with the grounded cylinder. Argon gas was directed to the region of the wire tips, at a rate of approximately 3 C.F.H. As the sheet surface passed under the wires, an electrical arc occurred between the wire tip and sheet surface. After a single pass of the sheet under the wires, the surface was imaged and the switch was opened. The sheet was removed from the cylinder, rinsed with a 1:15 solution (by volume) of 3M Fountain Solution, distributed by 3M Printing Products Division, St. Paul, Minn., and distilled water. The solution was left standing on the sheet for five minutes, thereby gumming the plate. The sheet was then rinsed with distilled water and inserted in a prepared cut-out in the central portion of a 3M R-Type plate, distributed by 3M Printing Products Division, St. Paul, Minn., which had been imaged previously with a diagnostic pattern, thereby forming a "hybrid" plate. The "hybrid" plate was then mounted in a Multilith 1250 Offset Lithographic Duplicator (made by AM International, Los Angeles, Calif.) in place of a conventionally prepared lithographic plate. The duplicator was inked with Pantone Process Blue No. 530-8000, (supplied by AM Multigraphics, a division of AM International, Mt. Prospect, Ill.). The fountain solution used was a solution of one part (by volume) Rosos Fountain Solution G-7A-V-Comb, supplied by Rosos, Inc., Lake Bluff, Ill., and 31 parts (by volume) distilled water. After mounting the sheet, the duplicator was run in the normal fashion, with the dampening rolls applying fountain solution to the sheet surface, followed by the inking rolls applying ink to the sheet surface. The fountain solution was observed to wet only those areas of the stainless steel insert where the arc had impinged. The ink, being immiscible with the fountain solution, coated only the remainder of the stainless steel insert containing no fountain solution. The rest of the plate, i.e., the conventional, diagnostically imaged plate, was selectively wet with the fountain solution as expected and, accepted ink in the diagnostic image areas. The inked image carried by the entire hybrid plate was transferred to the blanket cylinder, where it was transferred to paper. A clean, sharp, well-defined ink image resulted on the paper, which included an uninked line representing the area traced by the arc on the stainless steel insert. The sheet was used to print multiple copies on paper. No significant image degradation was observed.

To determine the erasability of the plate, and its suitability for re-use, the stainless steel insert was removed from the hybrid plate and cleaned by hand using Blankrola, distributed by AM Multigraphics, of Mt. Prospect, Ill. After air drying, the insert was rinsed with isopropyl alcohol and again air dried. The shim was securely re-mounted on the grounded steel cylinder at approximately a 45° angle to the direction of cylinder rotation. The plate was imaged as before, except that a voltage of +950 volts was used and the cylinder speed was fixed at 1.5 yards per minute. The resulting arced line crossed the original arced line at approximately a 45° angle. The arcing process was repeated 4 times over the same area. The shim was then rinsed with palmitic acid and gently rubbed with a paper tissue. Following this, the shim was rinsed with distilled water, then with the above fountain solution, then with distilled water, and then dried in a stream of nitrogen gas. The shim was inserted into the same prepared cut-out to form the "hybrid" plate as above, and remounted on the above lithographic duplicator. Multiple copies were printed which showed the same clean, sharp image as before, except that the original uninked line now had a small portion containing ink, corresponding to the region traced by the second arc which had removed the gum from that area and thereby allowed the hexadecanoic acid to coat the area. In effect, this region had been erased.

To re-image the shim, the hydrid plate was removed from the duplicator and the shim removed from the cut-out. After manual cleaning with Blankrola, the shim was dried and rinsed with isopropyl alcohol. The shim was then re-imaged as above, forming a line parallel to the direction of cylinder rotation directly over the initial imaged line, except that non-pulsating direct current was used. The shim was then re-inserted into the standard plate, as before, and mounted in the duplicator. Multiple copies were printed which showed the same clean sharp image that was originally visible after the first arcing. The same uninked line, corresponding to the area traced by the arc, appeared but without the former ink containing area visible in the previous print. In effect, this area had been re-imaged.

EXAMPLE VI

The procedures of Example V were repeated, except that a 4"×1" section of five mil thick aluminum shim stock, from the same supplier, was substituted for the stainless steel shim, with similar results.

EXAMPLE VII

A 4"×1" section of five mil thick type 304 stainless steel sheet, supplied by the Precision Steel Warehouse, Inc. of Downers Grove, Ill. was placed in an oven at 650° F for one minute, then dipped in the hexadecanoic acid solution of Example IV. The section was mounted on the apparatus of Example IV, with the cylinder traveling at the rate of 4.6 yards per minute, the imaging procedures of Example IV were followed. The gumming solution of Example IV was applied and let dry. An ink/fountain solution mixture comprising 60 ml of the above gumming solution and 10 drops of TERAPRINT Blue R disperse dye, distributed by Ciba Geigy Corporation, Greensboro, N.C., was applied to the sheet by a roller. The mixture adhered to the sheet only where the spark had traced, and nowhere else. The inked surface of the sheet was the pressed against a sheet of paper, whereupon the ink transferred to the paper, forming a clear, sharp image of the path traced by the spark. Re-application of the mixture to the sheet, and the subsequent transfer to paper, yielded similar results.

EXAMPLE VIII

A stainless steel sheet and a copper sheet, each 5 mils thick and each supplied by Precision Steel Warehouse, Inc., of Downers Grove, Ill., were separately illuminated by a pulsed ruby laser manufactured by Apollo Lasers, Inc. of Los Angeles, Calif. The laser had an average beam energy of 3.5 Joules, a beam cross-sectional area of approximately 0.0123 square inches, and a pulse width of 40 nonoseconds. The sheets were untreated before illumination, and therefore carried a film of machining oils and other materials associated with the manufacturing process which rendered the sheet surfaces hydrophobic as observed with distilled water. Immediately after illumination each sheet was dipped in distilled water and quickly withdrawn. The distilled water wet and adhered to each sheet in the precise area illuminated by the laser; all other areas of the sheets remained water repellent, indicating that the hydrophobic layer had been selectively removed in a pre-determined configuration and a precise, well-defined hydrophilic/hydrophobic image had been inscribed onto each sheet.

EXAMPLE IX

The procedure of Example VIII was repeated, using 5 mil sheets of zinc and aluminum by Alfa Products of Danvers, Mass., in place of the stainless steel and copper sheets. Similar results were obtained.

While specific components of the present system are disclosed above, many variations may be introduced which may in any way enhance, improve, or otherwise effect the system. While specific variations are given in this description, modifications and ramifications which occur to those skilled in the art upon reading this description are also intended to be included herein.

EXAMPLE X

A small grooved roll similar to a rotogravure roll and having 120 grooves per linear inch, arranged in approximately a 45° helix was placed in an oven at 600° F. for one minute to clean the surface. The roll was then dipped in the hexadecanoic acid solution of Example V and immediately rinsed with water. The roll was then imaged, using the procedures of Example V, except the voltage was +950 volts, the series resistance was 200 kilohms. Four short, evenly laterally spaced dashes were traced by the spark. The roll was the squirted with an ink comprising (by volume) 50% distilled water and 50% Sheaffer Skrip blue fountain pen ink, distributed by Sheaffer Eaton, Fort Madison, Iowa. A rubber doctor blade was used to remove excess ink. The ink wet only those areas of the roll traced by the sparks. The roll was pressed against a sheet of paper. Four short, inked dashes were formed on the paper. Multiple copies were produced. All images were clean and sharp.

While specific components of the present system are disclosed above, many variations may be introduced which may in any way enhance, improve, or otherwise affect the system. While specific variations are given in this description, modifications and ramifications which occur to those skilled in the art upon reading this description are also intended to be included herein.

I claim:

1. A method for preparing a gravure cylinder, having a latent image on at least one surface thereof, for use in a printing process wherein, after printing a first image, the cylinder may be re-imaged to permit printing of a second, different image, said method comprising:

(a) providing a clean hydrophilic contoured surface containing a plurality of gravure cells, said surface consisting essentially of an intrinsically substantially hydrophilic material;

(b) applying, in direct contact with said surface, a substantially thin, hydrophobic and oleophilic layer of material, said material of said layer having an affinity for said surface and conforming to said contoured surface containing said cells without substantially changing the contour of said surface or substantially filling said cells and being capable of being removed and re-applied without substantial change to said contoured surface or substantial interruption of the printing process; and (c) forming said latent image on said surface by removing, in an image-related configuration, a portion of said layer from said surface.

2. The method of claim 1 wherein said hydrophobic layer material is selected from the group consisting of carboxylic acids, carboxylic acid salts, metal soaps, anionic surfactants, hydrocarbon waxes, inorganic hydrophobic material, ethoxylated carboxylic acids, carboxylic acid anhydrides, and polymers.

3. The method of claim 2 wherein said layer material is selected from the group consisting of carboxylic acids, carboxylic acid salts, carboxylic acid anhydrides, and polymers.

4. The method of claims 2 or 3 wherein forming said latent image results is exposing said contoured surface in said configuration.

5. The method of claim 2 wherein said layer material is hexadecanoic acid, octadecanoic acid, polyvinyl butyral, or acrylic resin.

6. The method of claim 1 wherein an aqueous developer material is applied following the formation of said latent image.

7. The method of claim 6 wherein an oleo ink is applied following the application of said aqueous developer material.

8. A method for forming a latent image on a gravure cylinder in an automatic manner, comprising:

(a) providing a clean cylinder having a contoured surface containing gravure cells, which surface is intrinsically substantially hydrophilic;

(b) automatically moving said cylinder through a plurality of stations, said stations collectively performing the following process steps on said cylinder;

(c) applying a layer of material to said cylinder which conforms to said contoured surface without filling said gravure cells and which provides a hydrophobic and oleophilic surface; and (d) forming said latent image on said cylinder by removing selected areas of said hydrophobic surface in an image-related configuration by selective application of energy to said hyrophobic surface.

9. A method for automatically forming and changing a latent image on a gravure cylinder which relies on the immiscibility of hydrophobic and hydrophilic materials to print images therefrom, said method comprising:

(a) providing a gravure cylinder having an uncontaminated contoured surface which is intrinsically substantially hydrophilic;

(b) applying a material to said surface which conforms thereto and provides a hydrophobic and oleophilic surface where applied;

(c) forming said latent image on said gravure cylinder by removing selected portions of said hydrophobic surface in an image-related configuration by the selective application of energy to said hydrophobic cylinder surface;

(d) removing all materials from said cylinder surface, including all remaining portions of said hydrophobic surface, thereby exposing said hydrophilic cylinder surface; and (e) automatically moving said cylinder surface through a plurality of stations which collectively perform steps b–d while controlling the operation of steps b–d, using steps b and c in sequence to place a latent image on said cylinder and by using steps d, b and c, in that sequence, to change said latent image on said cylinder.

10. The method of claims 1, 8 or 9 wherein said latent image formation step is done without photo-induced chemical reaction.

11. The method of claims 1, 8 or 9 wherein said hydrophobic layer material is applied to said surface as a substantially monomolecular layer.

12. The method of claim 11 wherein said hydrophobic layer material is selected from the group consisting of carboxylic acids, carboxylic acid salts, metal soaps, anionic surfactants, hydrocarbon waxes, hydrophobic inorganic materials, ethoxylated carboxylic acids, carboxylic acid anhydrides, and polymers.

13. The method of claims 8 or 9 further comprising the step of applying an aqueous developer material to said cylinder following the selective application of energy.

14. The method of claim 13 further comprising the step of applying an oleo developer material to said cylinder following said step of applying said aqueous developer material, said oleo material adhering only to intact hydrophobic surface areas.

15. The method of claims 1, 8 or 9 wherein said hydrophobic layer material is removed by ablation.

16. The method of claim 15 wherein said hydrophobic layer material is removed by an electrical spark discharge.

* * * * *

UNITED STATES PATENT AND TRADEMARK OFFICE

CERTIFICATE OF CORRECTION

PATENT NO. : 4,729,310

DATED : March 8, 1988

INVENTOR(S) : Franklin Sadler Love, III

It is certified that error appears in the above-identified patent and that said Letters Patent is hereby corrected as shown below:

Column 13, line 25: the word "substantially" should be "schematically".

Column 15, line 33: the word "on" should be "one".

Column 19, line 17: the word "secured" should be "actuated".

Column 30, line 44: the word "the" (2nd occurrence) should be "then".

Signed and Sealed this

Seventh Day of February, 1989

*Attest:*

*Attesting Officer*

DONALD J. QUIGG

*Commissioner of Patents and Trademarks*